US012442374B2

(12) United States Patent
Tsuchiya et al.

(10) Patent No.: US 12,442,374 B2
(45) Date of Patent: Oct. 14, 2025

(54) SCREW COMPRESSOR WITH IMPROVED SUCTION FLOW

(71) Applicant: HITACHI INDUSTRIAL EQUIPMENT SYSTEMS CO., LTD., Tokyo (JP)

(72) Inventors: Takeshi Tsuchiya, Tokyo (JP); Kotaro Chiba, Tokyo (JP); Toshiaki Yabe, Tokyo (JP); Kohei Sakai, Tokyo (JP); Yuki Taniyama, Tokyo (JP); Sho Nikaido, Tokyo (JP); Shotaro Sano, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 18/843,632

(22) PCT Filed: Mar. 3, 2023

(86) PCT No.: PCT/JP2023/008100

§ 371 (c)(1),
(2) Date: Sep. 3, 2024

(87) PCT Pub. No.: WO2023/176517

PCT Pub. Date: Sep. 21, 2023

(65) Prior Publication Data

US 2025/0188929 A1 Jun. 12, 2025

(30) Foreign Application Priority Data

Mar. 15, 2022 (JP) ..... 2022-040336

(51) Int. Cl.
*F04C 18/16* (2006.01)
*F04C 29/12* (2006.01)

(52) U.S. Cl.
CPC ..... *F04C 18/16* (2013.01); *F04C 29/12* (2013.01); *F04C 2240/30* (2013.01); *F04C 2250/101* (2013.01)

(58) Field of Classification Search
CPC ..... F04C 18/16; F04C 29/12; F04C 2240/30; F04C 2250/101
See application file for complete search history.

(56) References Cited

U.S. PATENT DOCUMENTS 6,659,729 B2 * 12/2003 Hattori ..... F04C 28/125 417/282
11,873,817 B2 * 1/2024 Tsuchiya ..... F04C 18/16
2022/0049700 A1 2/2022 Chiba et al.

FOREIGN PATENT DOCUMENTS

JP 59-96494 A 6/1984
JP 2000-337283 A 12/2000
(Continued)

OTHER PUBLICATIONS

International Search Report of PCT/JP2023/008100 dated May 9, 2023.

(Continued)

*Primary Examiner* — Mary A Davis
(74) *Attorney, Agent, or Firm* — Mattingly & Malur, PC

(57) ABSTRACT

A suction flow path of a screw compressor includes a male-side flow path that opens in an axial direction with respect to working chambers in a suction process on the male rotor side and extends from a starting end positioned on one side of a virtual plane to a first termination end positioned on the other side; and a female-side flow path on the female rotor side that extends from the starting end to a second termination end positioned on the other side of the virtual plane. The male-side or the female-side first flow path wall is configured such that at least a partial area in a range from the starting end to the first or the second (Continued)

termination end is closer to a male-side or female-side rotor lobe section from the starting end side toward the first or second termination end side.

8 Claims, 13 Drawing Sheets

(56) References Cited

FOREIGN PATENT DOCUMENTS

| | | | |
|---|---|---|---|
| JP | 2010-275995 | A | 12/2010 |
| JP | 2021-028474 | A | 2/2021 |

OTHER PUBLICATIONS

International Preliminary Report on Patentability received in corresponding International Application No. PCT/JP2023/008100 dated Sep. 26, 2024.

* cited by examiner

COMPARATIVE EXAMPLE

COMPARATIVE EXAMPLE

COMPARATIVE EXAMPLE

COMPARATIVE EXAMPLE

SCREW COMPRESSOR WITH IMPROVED SUCTION FLOW

TECHNICAL FIELD

The present invention relates to a screw compressor, and more particularly to a screw compressor including a suction flow path that opens to working chambers in a suction process.

BACKGROUND ART

A screw compressor includes a pair of male and female screw rotors that rotates while meshing with each other and a casing that houses both the screw rotors. In this compressor, a plurality of working chambers are formed by lobe grooves of both the screw rotors and an inner wall surface of the casing surrounding them. The casing is provided with a suction flow path for introducing gas (working fluid) from the outside to the working chambers and a discharge flow path for introducing compressed gas from the working chambers to the outside. The working chambers increase the volume, while moving in the axial direction with rotation of both the screw rotors, to suck gas through the suction flow path, then decrease the volume to compress the gas, and finally discharge the compressed gas through the discharge flow path. As described above, the working chambers sequentially repeat a suction process for sucking the gas through the suction flow path, a compression process for compressing the gas, and a discharge process for discharging the compressed gas through the discharge flow path.

As the suction flow paths of the screw compressor, there are a suction flow path on the male rotor side and a suction flow path on the female rotor side that communicate with the working chambers in the suction process in the rotor axial direction, and are located on the downstream side with respect to a virtual plane passing through both center axis lines of the male and female rotors (see, for example, Patent Document 1).

PRIOR ART DOCUMENT

Patent Document

Patent Document 1: JP-2021-28474-A

SUMMARY OF THE INVENTION

Problems to be Solved by the Invention

Incidentally, in a liquid flooded type screw compressor, when miniaturization is attempted in order to reduce the cost, it is inevitable to increase the speed of the screw rotors. In a liquid free type screw compressor, since the sealing effect by liquid supply as in the liquid flooded type cannot be expected, the screw rotors are often operated by high speed rotation in order to reduce a leakage loss from the working chambers.

In the case where the screw rotors are operated by high speed rotation, the working fluid flowing into the working chambers from the suction flow path is accelerated to match the high speed rotation. If the working fluid flowing in the suction flow path decelerates, the speed of the working fluid to flow into the working chambers from the suction flow path is accordingly reduced, and thus the amount of acceleration of the working fluid increases. This means that the driving power of the screw compressor increases. Therefore, an increase in the amount of acceleration of the working fluid due to the deceleration of the working fluid flowing in the suction flow path results in an energy loss (hereinafter, referred to as an acceleration loss in some cases) and deteriorates the efficiency of the screw compressor.

In the screw compressor described in Patent Document 1, the working fluid flows in the suction flow path on the male rotor side and the suction flow path on the female rotor side, which communicate with the working chambers in the suction process in the rotor axial direction, from the branch side of both the flow paths toward the downstream side with respect to the virtual plane (see the void arrow in FIG. 4 of Patent Document 1). At this time, as the working fluid flows along the rotor circumferential direction from the branch side of the suction flow path on the male rotor side and the suction flow path on the female rotor side toward the downstream side, it is gradually sucked into the working chambers through an opening in the axial direction. Therefore, the flow rate of the working fluid gradually decreases from the branch side of the suction flow path on the male rotor side and the suction flow path on the female rotor side toward the downstream end by the amount sucked into the working chambers.

It is conceivable that the screw compressor described in Patent Document 1 has a structure in which the flow path cross-sectional areas of the suction flow path on the male rotor side and the suction flow path on the female rotor side is substantially constant from the branch side to the downstream end. In the suction flow path on the male rotor side and the suction flow path on the female rotor side having such a structure, when the flow rate of the working fluid gradually decreases toward the downstream side, the flow speed of the working fluid accordingly decelerates toward the downstream side. Therefore, as described above, the deceleration of the working fluid flowing through the suction flow path on the male rotor side and the suction flow path on the female rotor side causes an acceleration loss, and thus the efficiency of the screw compressor is deteriorated.

The present invention has been made in order to solve the above problems, and an object thereof is to provide a screw compressor capable of reducing an acceleration loss caused by deceleration of working fluid flowing through a suction flow path.

Means for Solving the Problems

The present application includes a plurality of means for solving the above problems, and one example thereof is a screw compressor including: a male rotor that has a first rotor lobe section and is rotatable around a first axis line; a female rotor that has a second rotor lobe section and is rotatable around a second axis line; and a casing that has a housing chamber for housing the first rotor lobe section and the second rotor lobe section in a state where they mesh with each other and forms a plurality of working chambers together with the first rotor lobe section and the second rotor lobe section. Further, the casing has a suction flow path that introduces working fluid from an outside of the casing to the working chambers in a suction process. The suction flow path includes a male-side flow path that opens in an axial direction of the male rotor with respect to working chambers on the male rotor side among the working chambers in the suction process and extends from a first starting end that is positioned on one side with respect to a virtual plane passing through the first axis line and the second axis line and is on an inflow side of the working fluid to a first termination end positioned on the other side with respect to the virtual plane, and a female-side flow path that opens in an axial direction of the female rotor with respect to working chambers on the female rotor side among the working chambers in the suction process and extends from a second starting end that is positioned on the one side with respect to the virtual plane and is on the inflow side of the working fluid to a second termination end positioned on the other side with respect to the virtual plane. In addition, a flow path wall defining the male-side flow path includes a male-side first flow path wall that faces a suction-side end face side of the first rotor lobe section and extends from the first starting end to the first termination end, a flow path wall defining the female-side flow path includes a female-side first flow path wall that faces a suction-side end face side of the second rotor lobe section and extends from the second starting end to the second termination end. The male-side first flow path wall is configured such that at least a partial area in a range from the first starting end to the first termination end is closer to the first rotor lobe section from the first starting end side toward the first termination end side, or the female-side first flow path wall is configured such that at least a partial area in a range from the second starting end to the second termination end is closer to the second rotor lobe section from the second starting end side toward the second termination end side.

Advantages of the Invention

According to the present invention, the male-side first flow path wall for the male-side flow path, which opens in the rotor axial direction with respect to the working chambers in the suction process, is closer to the first rotor lobe section toward the first termination end side, or the female-side first flow path wall in the female-side flow path is closer to the second rotor lobe section toward the second termination end side. Therefore, the flow path cross-sectional area of the male-side flow path decreases toward the first termination end side or the flow path cross-sectional area of the female-side flow path decreases toward the second termination end side. This causes the deceleration of the working fluid flowing through the male-side flow path or the female-side flow path to be suppressed, thereby reducing the acceleration loss caused by the deceleration of the working fluid flowing through the suction flow path.

Problems, configurations, and effects other than those described above will be clarified by the following description of embodiments.

MODES FOR CARRYING OUT THE INVENTION

Hereinafter, embodiments of a screw compressor of the present invention will be exemplarily described by using the drawings.

First Embodiment

Figure 1:
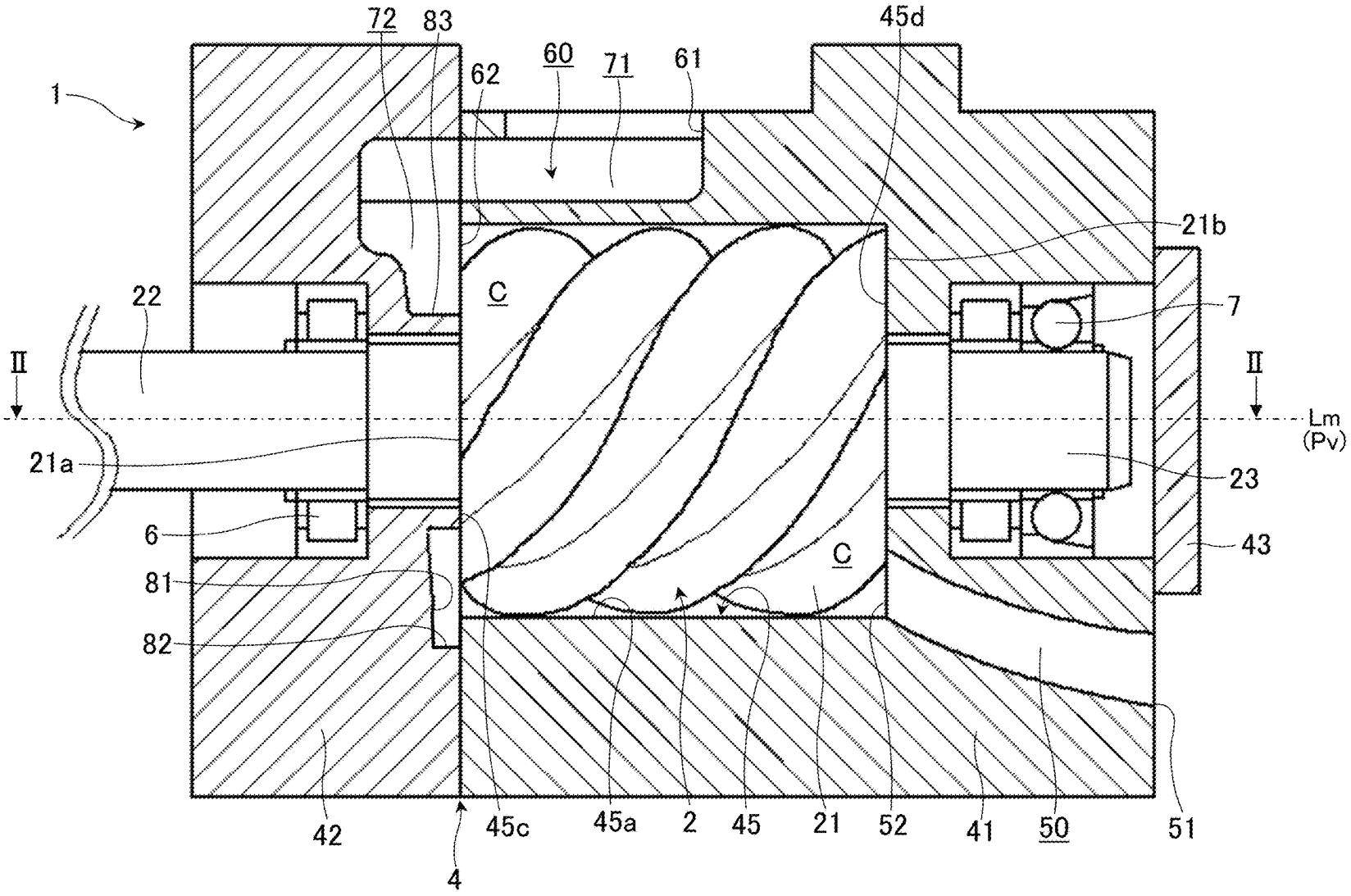
FIG. 1 is a longitudinal cross-sectional view depicting a screw compressor according to a first embodiment of the present invention.
Figure 2:
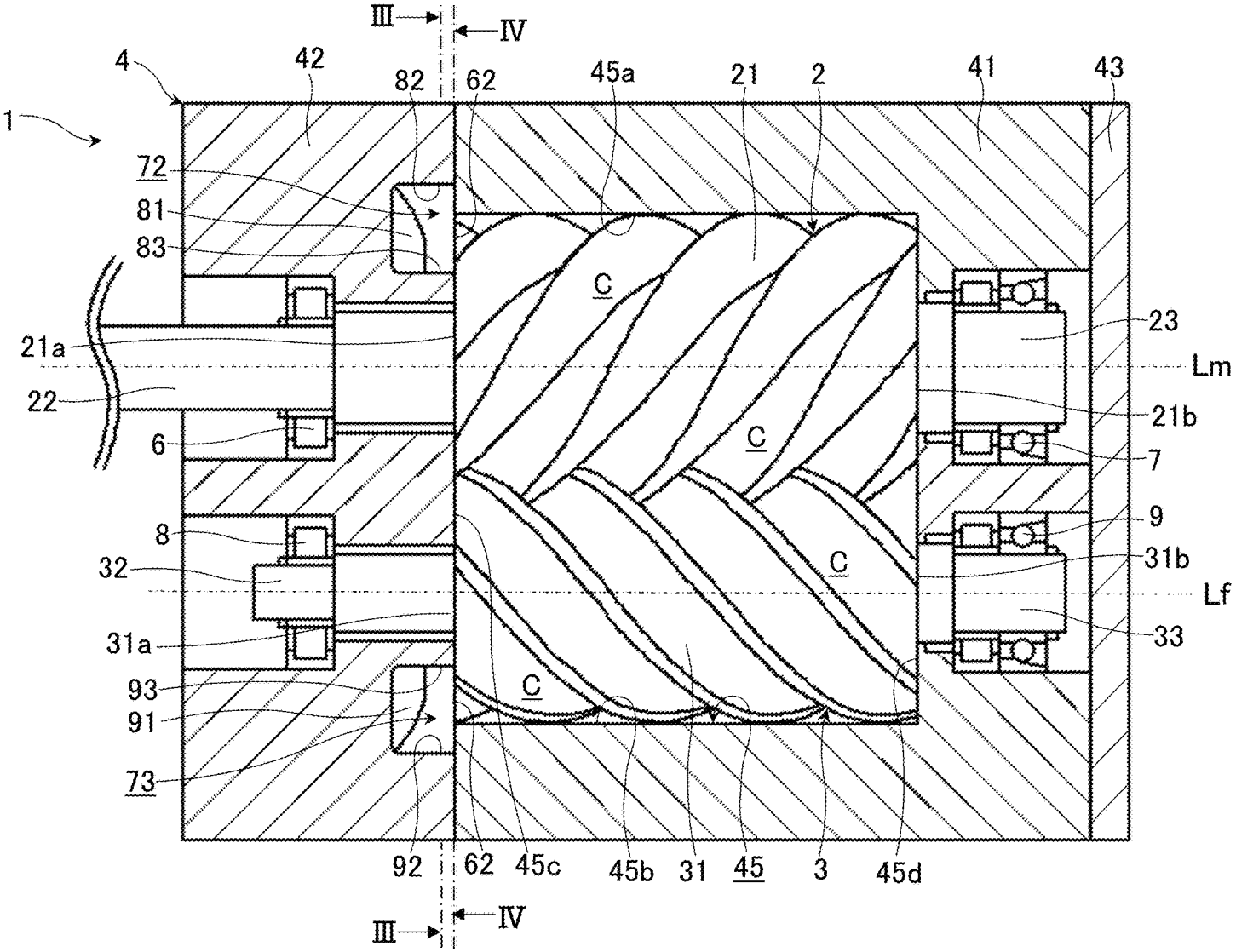
FIG. 2 is a longitudinal cross-sectional view of the screw compressor according to the first embodiment depicted in FIG. 1 when viewed in the II-II arrow direction.
Figure 3:
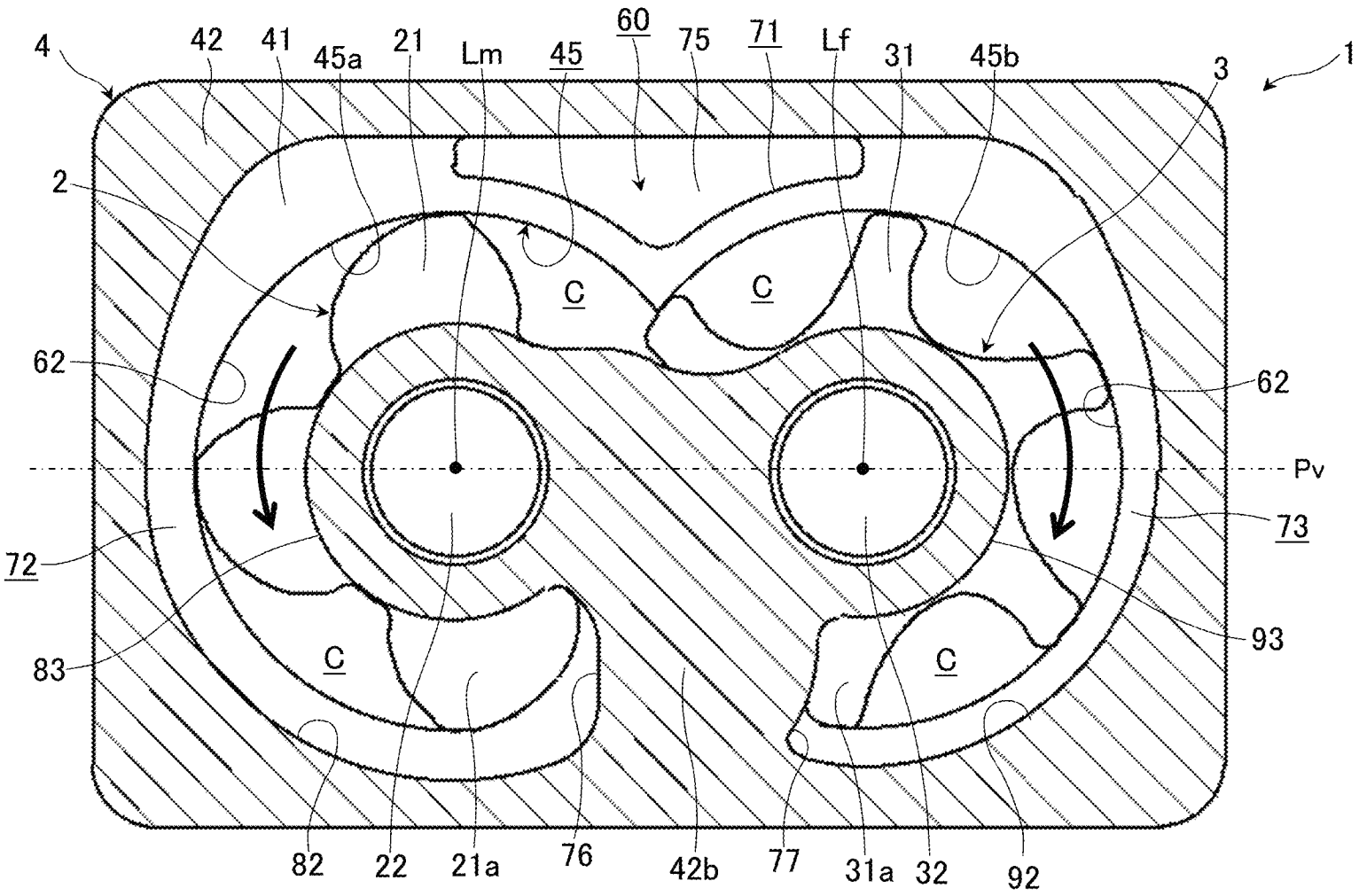
FIG. 3 is a transverse cross-sectional view of the screw compressor according to the first embodiment depicted in FIG. 2 when viewed in the III-III arrow direction.

A schematic configuration of a screw compressor according to a first embodiment will be described by using FIG. 1 to FIG. 3. FIG. 1 is a longitudinal cross-sectional view depicting the screw compressor according to the first embodiment of the present invention. FIG. 2 is a longitudinal cross-sectional view of the screw compressor according to the first embodiment depicted in FIG. 1 when viewed in the II-II arrow direction. FIG. 3 is a transverse cross-sectional view of the screw compressor according to the first embodiment depicted in FIG. 2 when viewed in the III-III arrow direction.

In FIG. 1 and FIG. 2, a screw compressor 1 includes a male rotor 2 and a female rotor 3 as a pair of screw rotors that rotate while meshing with each other, and a casing 4 for housing both the male and female rotors 2 and 3. The male rotor 2 is supported by a suction-side bearing 6 and a discharge-side bearing 7 rotatably around an axis line Lm. The female rotor 3 is supported by a suction-side bearing 8 and a discharge-side bearing 9 rotatably around an axis line Lf parallel to the axis line Lm of the male rotor 2.

The male rotor 2 is configured with a rotor lobe section 21 having a plurality of spiral male lobes, and a suction-side shaft section 22 and a discharge-side shaft section 23 provided at both end of the rotor lobe section 21 in the axial direction. The rotor lobe section 21 has a suction-side end face 21*a* and a discharge-side end face 21*b* orthogonal to the axial direction (axis line Lm) at one end (left end in FIG. 1 and FIG. 2) and the other end (right end in FIG. 1 and FIG. 2) in the axial direction, respectively. In the rotor lobe section 21, lobe grooves are formed between a plurality of male lobes. For example, the suction-side shaft section 22 is configured to penetrate the casing 4, and is coupled to a rotary driving source, which is not depicted. For example, an electric motor is used as the rotary driving source.

The female rotor 3 is configured with a rotor lobe section 31 having a plurality of spiral female lobes, and a suction-side shaft section 32 and a discharge-side shaft section 33 provided at both end of the rotor lobe section 31 in the axial direction. The rotor lobe section 31 has a suction-side end face 31*a* and a discharge-side end face 31*b* orthogonal to the axial direction (axis line Lf) at one end (left end in FIG. 2) and the other end (right end in FIG. 2) in the axial direction, respectively. In the rotor lobe section 31, lobe grooves are formed between a plurality of female lobes.

The casing 4 has a bottomed cylindrical main casing 41 that opens on one side (left side in FIG. 1 and FIG. 2) in the axial direction that is the suction side, and a suction-side casing 42 that is attached to the main casing 41 so as to close the opening of the main casing 41 and is a member different from the main casing 41. The casing 4 has a bore 45 as a housing chamber that houses the rotor lobe section 21 of the male rotor 2 and the rotor lobe section 31 of the female rotor 3 in a state where they mesh with each other. As depicted in FIG. 3, the bore 45 is formed in the main casing 41 in such a manner that a cylindrical hole for housing the rotor lobe section 21 of the male rotor 2 partially overlaps with a cylindrical hole for housing the rotor lobe section 31 of the female rotor 3. As depicted in FIG. 1 to FIG. 3, the wall face defining the housing chamber of the casing 4 is configured with a male-side inner peripheral wall face 45*a* that covers the radially outer side of the rotor lobe section 21 of the male rotor 2, a female-side inner peripheral wall face 45*b* that covers the radially outer side of the rotor lobe section 31 of the female rotor 3, a suction-side inner wall face 45*c* on one side (left side in FIG. 1 and FIG. 2) in the axial direction (a portion of an end face 42*a* (see FIG. 4 to be described later) of the suction-side casing 42 on the main casing 41 side) facing the suction-side end faces 21*a* and 31*a* of the rotor lobe sections 21 and 31 of the male and female rotors 2 and 3, and a discharge-side inner wall face 45*d* on the other side (right side in FIG. 1 and FIG. 2) in the axial direction facing the discharge-side end faces 21*b* and 31*b* of the rotor lobe sections 21 and 31 of the male and female rotors 2 and 3. A plurality of working chambers C are formed by lobe grooves of the rotor lobe sections 21 and 31 of the male rotor 2 and the female rotor 3 housed in the housing chamber (bore 45) and the inner wall faces (the male-side inner peripheral wall face 45*a*, the female-side inner peripheral wall face 45*b*, the suction-side inner wall face 45*c*, and the discharge-side inner wall face 45*d*) of the casing 4 surrounding the lobe grooves.

As depicted in FIG. 1 and FIG. 2, the discharge-side bearing 7 for the male rotor 2 and the discharge-side bearing 9 for the female rotor 3 are arranged in the main casing 41, and a discharge-side cover 43 is attached to the main casing 41 so as to cover the discharge-side bearing 7 and the discharge-side bearing 9. The suction-side bearing 6 for the male rotor 2 and the suction-side bearing 8 for the female rotor 3 are arranged in the suction-side casing 42.

As depicted in FIG. 1, the casing 4 is provided with a discharge flow path 50 that introduces compressed gas from the working chambers C to the outside of the casing 4. The discharge flow path 50 communicates the working chambers C in a discharge process with the outside of the casing 4, and has a discharge opening 51 that is an opening of the casing 4 on the outer wall side and a discharge port 52 that is an opening on the bore 45 side. The discharge port 52 is provided at a position on the other side (right side in FIG. 1) of the bore 45 in the axial direction and at a position on one side (lower side in FIG. 1) with respect to a virtual plane Pv passing through the axis lines Lm and Lf of both the male rotor 2 and the female rotor 3.

In addition, the casing 4 is provided with a suction flow path 60 that introduces gas from the outside of the casing 4 to the working chambers C. The suction flow path 60 communicates the outside of the casing 4 with the working chambers C in a suction process, and has a suction opening 61 that is an opening of the casing 4 on the outer wall side and a suction port 62 that is an opening on the bore 45 side.

For example, the suction opening 61 is provided at a position on one side (left side in FIG. 1) in the axial direction on the outer peripheral face of the casing 4 and on the other side (upper side in FIG. 1) with respect to the virtual plane Pv. The suction port 62 is formed as, for example, an axial suction port that opens only in the axial direction with respect to the working chambers C in the suction process. Details of the structure such as the shape of the suction flow path 60 in the present embodiment will be described later.

In the screw compressor 1 configured as described above, when the male rotor 2 depicted in FIG. 2 is driven by the rotary driving source, the female rotor 3 is rotationally driven by the male rotor 2, and working fluid is sucked into the screw compressor 1. The working fluid is sucked into the working chambers C through the suction port 62 from the suction flow path 60 depicted in FIG. 1. The working chambers C increase or decrease in volume while moving in the axial direction with the progress of the rotation of both the male and female rotors 2 and 3 depicted in FIG. 2. Specifically, the working chambers C first gradually increase in volume according to the progress of the rotation of both the male and female rotors 2 and 3 to suck the working fluid (suction process). After the suction process finishes, the working chambers C gradually decrease in volume according to the progress of the rotation of both the male and female rotors 2 and 3 to compress the working fluid (compression process). When the rotation of both the male and female rotors 2 and 3 further progresses, the working chambers C communicate with the discharge port 52, and the compressed fluid in the working chambers is discharged to the outside of the casing 4 through the discharge flow path 50. The volume of the working chambers C eventually becomes almost zero, and the working chambers C turn into the suction process for sucking the working fluid again. The screw compressor 1 continuously compresses the working fluid by repeating these processes.

It should be noted that the screw compressor 1 of the present embodiment is configured in such a manner that the male rotor 2 is driven by the rotary driving source to drive the female rotor 3. However, the screw compressor 1 can also be configured in such a manner that the female rotor 3 is driven by the rotary driving source to drive the male rotor 2, or both the male and female rotors 2 and 3 are synchronously driven.

In addition, the screw compressor 1 of the present embodiment is illustrated as a liquid free type compressor without an injection port for injecting liquid such as oil or water into the working chambers C. However, a liquid flooded type screw compressor that injects liquid from an injection port into the working chambers C may be used. In the case where the screw compressor 1 is of a liquid free type, it is necessary to rotate the rotor lobe section 21 of the male rotor 2 and the rotor lobe section 31 of the female rotor 3 in a non-contact state, and rotary engaging means such as a timing gear for rotationally engaging the male rotor 2 and the female rotor 3 with each other is provided, but the illustration of the rotary engaging means is omitted in FIG. 1 and FIG. 2. In addition, the illustrations of systems for supplying oil to the suction-side bearings 6 and 8 and the discharge-side bearings 7 and 9 and shaft sealing means of the shaft sections of both the male and female rotors 2 and 3 are also omitted.

Figure 4:
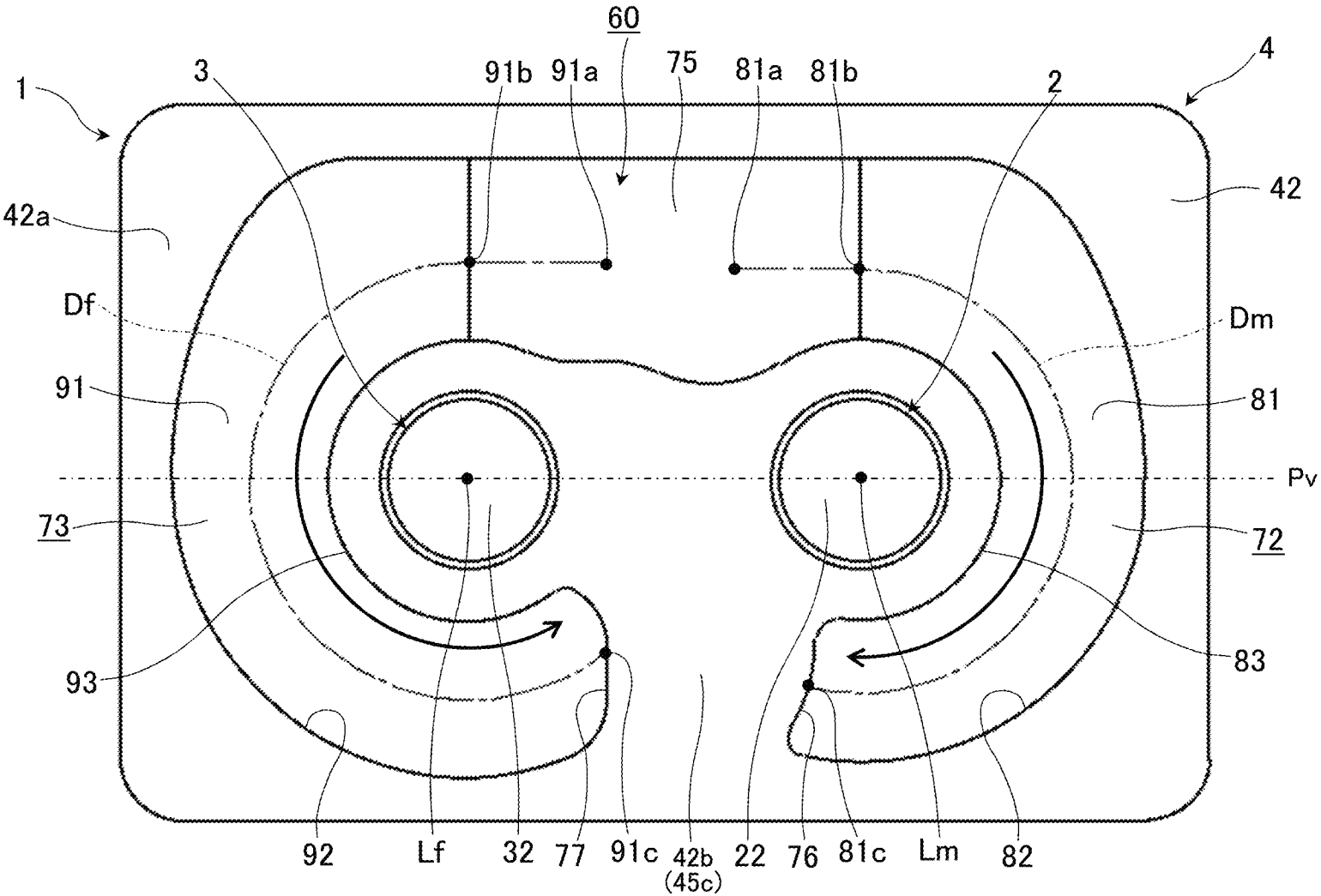
FIG. 4 is a diagram of the screw compressor according to the first embodiment when viewed in the IV-IV arrow direction depicted in FIG. 2.
Figure 5:
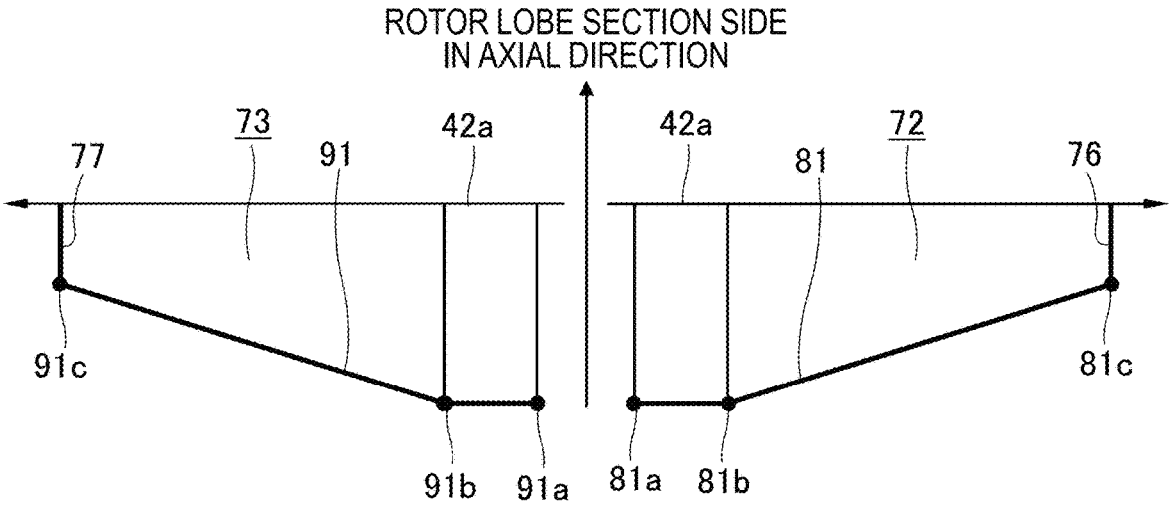
FIG. 5 is an explanatory view depicting an example of the shape of a first flow path wall (the shape of a recessed portion defining a suction flow path) in the suction flow path of the screw compressor according to the first embodiment depicted in FIG. 4.
Figure 6:
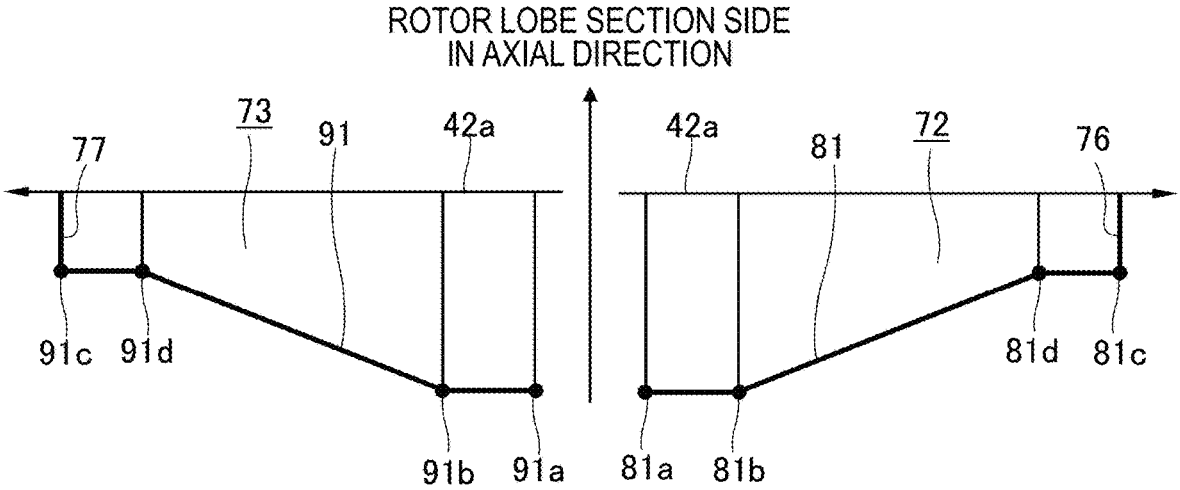
FIG. 6 is an explanatory view depicting another example of the shape of the first flow path wall (the shape of the recessed portion defining the suction flow path) in the suction flow path of the screw compressor according to the first embodiment.

Next, details of the structure of the suction flow path of the screw compressor according to the first embodiment will be described by using FIG. 1 to FIG. 6. FIG. 4 is a diagram of the screw compressor according to the first embodiment when viewed in the IV-IV arrow direction depicted in FIG. 2. FIG. 5 is an explanatory view depicting an example of the shape of a first flow path wall (the shape of a recessed portion defining the suction flow path) in the suction flow path of the screw compressor according to the first embodiment depicted in FIG. 4. FIG. 6 is an explanatory view depicting another example of the shape of the first flow path wall (the shape of the recessed portion defining the suction flow path) in the suction flow path of the screw compressor according to the first embodiment. In FIG. 3 and FIG. 4, the bold arrows indicate the rotation directions of the screw rotors.

As depicted in FIG. 1 to FIG. 4, the suction flow path 60 of the casing 4 has an introduction flow path 71 that extends from the suction opening 61, a male-side branch flow path 72 that branches from the introduction flow path 71 and extends along the circumferential direction of the male rotor 2 on the suction-side end face 21*a* side of the rotor lobe section 21 of the male rotor 2, and a female-side branch flow path 73 that branches from the introduction flow path 71 and extends along the circumferential direction of the female rotor 3 on the suction-side end face 31*a* of the rotor lobe section 31 of the female rotor 3. As depicted in FIG. 3, the male-side branch flow path 72 and the female-side branch flow path 73 open (communicate) with respect to the working chambers C in the suction process to form suction spaces for sucking the working fluid into the working chambers C. The introduction flow path 71 introduces the working fluid to the male-side branch flow path 72 and the female-side branch flow path 73 serving as the suction spaces, and is a flow path not opened to the working chambers C. The introduction flow path 71 is configured to be connected to the male-side branch flow path 72 and the female-side branch flow path 73 at a position on the other side (upper side in FIG. 1 and FIG. 3) of the casing 4 with respect to the virtual plane Pv (that is, the position opposite to the discharge port 52 with respect to the virtual plane Pv). For example, the introduction flow path 71 is formed so as to extend along the rotor axial direction at a position radially outside the bore 45 of the casing 4.

The male-side branch flow path 72 and the female-side branch flow path 73 extend from the connection position (that is, the inflow position of the working fluid) with the introduction flow path 71 to the position of a closing part 42*b* of the casing 4 formed in a region on one side (lower side in FIG. 1 and FIG. 3) with respect to the virtual plane Pv. The closing part 42*b* closes the openings of the lobe grooves in the axial direction at the suction-side end faces 21*a* and 31*a* of the rotor lobe sections 21 and 31 of both the male and female rotors 2 and 3 when the working chambers C reach a predetermined volume by the rotation of both the male and female rotors 2 and 3. In the present embodiment, as depicted in FIG. 4, in the male-side branch flow path 72 and the female-side branch flow path 73, the region that is the connection region with the introduction flow path 71 and the branch region where they branch from each other is referred to as a starting end 75 of the male-side branch flow path 72 and the female-side branch flow path 73, an end of the male-side branch flow path 72 on the closing part 42*b* side is referred to as a male-side termination end 76, and an end of the female-side branch flow path 73 on the closing part 42*b* side is referred to as a female-side termination end 77. That is, the male-side branch flow path 72 extends along the circumferential direction of the male rotor 2 from the starting end 75 to the male-side termination end 76. The female-side branch flow path 73 extends along the circumferential direction of the female rotor 3 from the starting end 75 to the female-side termination end 77.

As depicted in FIG. 3, the male-side branch flow path 72 is configured to open in the axial direction with respect to the working chambers C in the suction process. As depicted in FIGS. 1, 3, and 4, the flow path wall defining the male-side branch flow path 72 has a first flow path wall 81 facing the suction-side end face 21*a* side of the rotor lobe section 21 of the male rotor 2, a second flow path wall 82 positioned outward in a radial direction of the male rotor 2, and a third flow path wall 83 positioned inward in the radial direction of the male rotor 2 from the second flow path wall 82. As similar to the male-side branch flow path 72, the female-side branch flow path 73 is configured to open in the axial direction with respect to the working chambers C in the suction process. The flow path wall defining the female-side branch flow path 73 has a first flow path wall 91 facing the suction-side end face 31*a* side of the rotor lobe section 31 of the female rotor 3, a second flow path wall 92 positioned outward in a radial direction of the female rotor 3, and a third flow path wall 93 positioned radially inward with respect to the second flow path wall 92. As depicted in FIG. 4, the male-side branch flow path 72 and the female-side branch flow path 73 can be formed by providing recessed portions in a C shape to the end face 42*a* of the suction-side casing 42. That is, the first flow path walls 81 and 91 configure the bottom surfaces of the recessed portions of the suction-side casing 42 recessed in the axial direction, and the second flow path walls 82 and 92 and the third flow path walls 83 and 93 configure the side walls of the recessed portions recessed in the axial direction.

As depicted in FIG. 3, the second flow path wall 82 of the male-side branch flow path 72 is configured to be positioned on the radially outer side of the male rotor 2 with respect to the male-side inner peripheral wall face 45*a* of the bore 45. The second flow path wall 92 of the female-side branch flow path 73 is configured to be positioned on the radially outer side of the female rotor 3 with respect to the female-side inner peripheral wall face 45*b* of the bore 45 as similar to the second flow path wall 82 of the male-side branch flow path 72. The third flow path wall 83 of the male-side branch flow path 72 is configured to substantially coincide with the lobe bottom diameter of the rotor lobe section 21 of the male rotor 2. The third flow path wall 93 of the female-side branch flow path 73 is also configured to substantially coincide with the lobe bottom diameter of the rotor lobe section 31 of the female rotor 3 as similar to the third flow path wall 83 of the male-side branch flow path 72. As depicted in FIG. 4, the interval in the rotor radial direction between the second flow path wall 82 and the third flow path wall 83 in the male-side branch flow path 72, that is, the flow path width of the male-side branch flow path 72 is configured to be substantially constant at least in a region on one side (lower side in FIG. 4) with respect to the virtual plane Pv. As similar to the above, the interval in the rotor radial direction between the second flow path wall 92 and the third flow path wall 93 in the female-side branch flow path 73, that is, the flow path width of the female-side branch flow path 73 is configured to be substantially constant at least in a region on one side (lower side in FIG. 4) with respect to the virtual plane Pv.

The first flow path wall 81 of the male-side branch flow path 72 is configured such that at least a partial area in a range from the starting end 75 to the male-side termination end 76 is gradually closer to the rotor lobe section 21 of the male rotor 2 from the starting end 75 side toward the male-side termination end 76 side. As similar to the above, the first flow path wall 91 of the female-side branch flow path 73 is configured such that at least a partial area in a range from the starting end 75 to the female-side termination end 77 is gradually closer to the rotor lobe section 31 of the female rotor 3 from the starting end 75 side toward the female-side termination end 77 side.

Specifically, the first flow path wall 81 of the male-side branch flow path 72 and the first flow path wall 91 of the female-side branch flow path 73 have shapes as depicted in, for example, FIG. 5. FIG. 5 is a diagram obtained by developing the male-side branch flow path 72 and the female-side branch flow path 73 depicted in FIG. 4 along the dashed lines Dm and Df.

The first flow path wall 81 of the male-side branch flow path 72 is configured as a flat face equally distant from the suction-side end face 21*a* of the rotor lobe section 21 of the male rotor 2 in an area from a point 81*a* positioned in the vicinity of the starting end 75 of the male-side branch flow path 72 to a certain point 81*b* is, and is configured as an inclined face gradually closer to the suction-side end face 21*a* of the male rotor 2 from the certain point 81*b* toward a point 81*c* positioned at the male-side termination end 76. That is, the first flow path wall 81 extends such that the inclined face closer to the suction-side end face 21*a* of the male rotor 2 reaches the male-side termination end 76 from a position on the other side (upper side in FIG. 4) with respect to the virtual plane Pv. In other words, the bottom surface of the recessed portion forming the male-side branch flow path 72 in the suction casing 42 is configured in such a manner that the depth in the axial direction is substantially constant in the area from the point 81*a* to the point 81*b*, and gradually becomes shallower from the point 81*b* toward the point 81*c*. The point 81*b* is located at a position that is on, for example, the starting end 75 side with respect to the virtual plane Pv, is orthogonal to the virtual plane Pv, and passes through the axis line Lm of the male rotor 2.

As similar to the above, the first flow path wall 91 of the female-side branch flow path 73 is configured as a flat face equally distant from the suction-side end face 31*a* of the rotor lobe section 31 of the female rotor 3 in an area from a point 91*a* positioned in the vicinity of the starting end 75 of the female-side branch flow path 73 to a certain point 91*b*, and is configured as an inclined face gradually closer to the suction-side end face 31*a* of the female rotor 3 from the certain point 91*b* toward a point 91*c* positioned at the female-side termination end 77. That is, the first flow path wall 91 extends such that the inclined face closer to the suction-side end face 31*a* of the female rotor 3 reaches the female-side termination end 77 from a position on the other side (upper side in FIG. 4) with respect to the virtual plane Pv. In other words, the bottom surface of the recessed portion forming the female-side branch flow path 73 in the suction casing 42 is configured in such a manner that the depth in the axial direction is substantially constant in the area from the point 91*a* to the point 91*b*, and gradually becomes shallower from the point 91*b* toward the point 91*c*. The point 91*b* is located at a position that is located on, for example, the starting end 75 side with respect to the virtual plane Pv, is orthogonal to the virtual plane Pv, and passes through the axis line Lf of the female rotor 3.

The first flow path wall 81 of the male-side branch flow path 72 and the first flow path wall 91 of the female-side branch flow path 73 can be configured to have shapes as depicted in, for example, FIG. 6. FIG. 6 is a diagram obtained by developing the male-side branch flow path 72 and the female-side branch flow path 73 depicted in FIG. 4 along the dashed lines Dm and Df.

Specifically, the first flow path wall 81 of the male-side branch flow path 72 is configured as a flat face equally distant from the suction-side end face 21*a* of the male rotor 2 in the area from the point 81*a* to the point 81*b* (similar to the case of FIG. 5), is configured as an inclined face gradually closer to the suction-side end face 21*a* of the male rotor 2 from the certain point 81*b* toward a certain point 81*d* before reaching the male-side termination end 76, and is configured as a flat face equally distant from the suction-side end face 21*a* of the male rotor 2 in an area from the certain point 81*d* to the point 81*c* positioned at the male-side termination end 76*s*. That is, the first flow path wall 81 is configured in such a manner that a predetermined area reaching the male-side termination end 76 is a flat face. In other words, the bottom surface of the recessed portion forming the male-side branch flow path 72 in the suction casing 42 is configured in such a manner that the depth in the axial direction is substantially constant in the area from the point 81*a* to the point 81*b*, gradually becomes shallower from the point 81*b* toward the point 81*d* before reaching the male-side termination end 76, and is substantially constant in the area from the point 81*d* to the point 81*c* positioned at the male-side termination end 76.

As similar to the above, the first flow path wall 91 of the female-side branch flow path 73 is configured as a flat face equally distant from the suction-side end face 31*a* of the female rotor 3 in the area from the point 91*a* to the point 91*b* (similar to the case of FIG. 5), is configured as an inclined face gradually closer to the suction-side end face 31*a* of the female rotor 3 from the certain point 91*b* toward a certain point 91*d* before reaching the female-side termination end 77, and is configured as a flat face equally distant from the suction-side end face 31*a* of the female rotor 3 in an area from the certain point 91*d* to the point 91*c* positioned at the female-side termination end 77. That is, the first flow path wall 91 is configured in such a manner that a predetermined area reaching the female-side termination end 77 is a flat face. In other words, the bottom surface of the recessed portion forming the female-side branch flow path 73 in the suction casing 42 is configured in such a manner that the depth in the axial direction is substantially constant in the area from the point 91*a* to the point 91*b*, gradually becomes shallower from the point 91*b* toward the point 91*d* before reaching the female-side termination end 77, and is substantially constant in the area from the point 91*d* to the point 91*c* positioned at the female-side termination end 77.

In the suction flow path 60 of the screw compressor 1 configured as described above, the working fluid flowing in from the introduction flow path 71 is sucked into the working chambers C through the suction port 62 that opens in the axial direction while flowing from the starting end 75 of the male-side branch flow path 72 toward the male-side termination end 76, and also is sucked into the working chambers C through the suction port 62 that opens in the axial direction while flowing from the starting end 75 of the female-side branch flow path 73 toward the female-side termination end 77.

Figure 7:
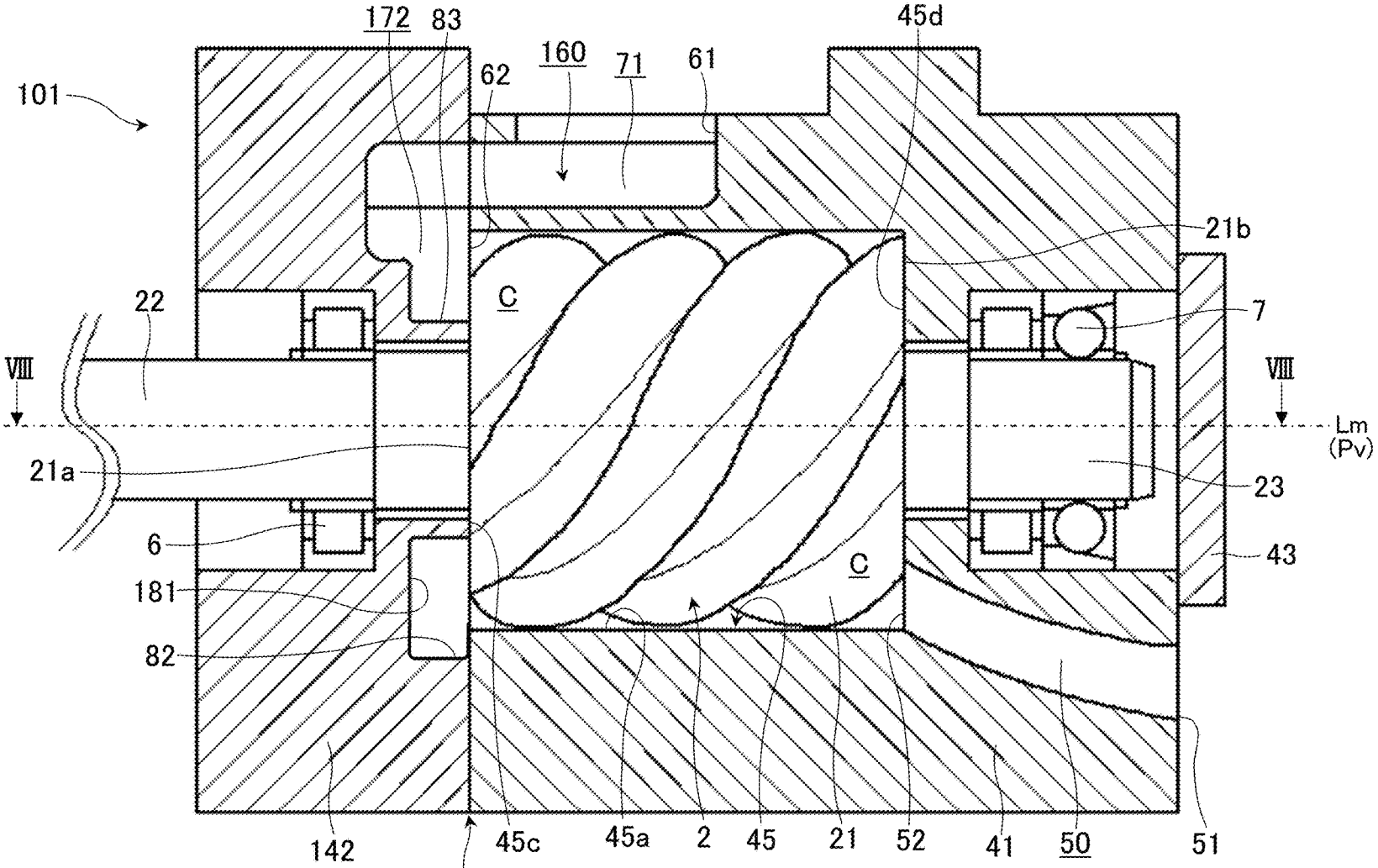
FIG. 7 is a longitudinal cross-sectional view depicting a screw compressor of a comparative example to the first embodiment of the present invention.
Figure 8:
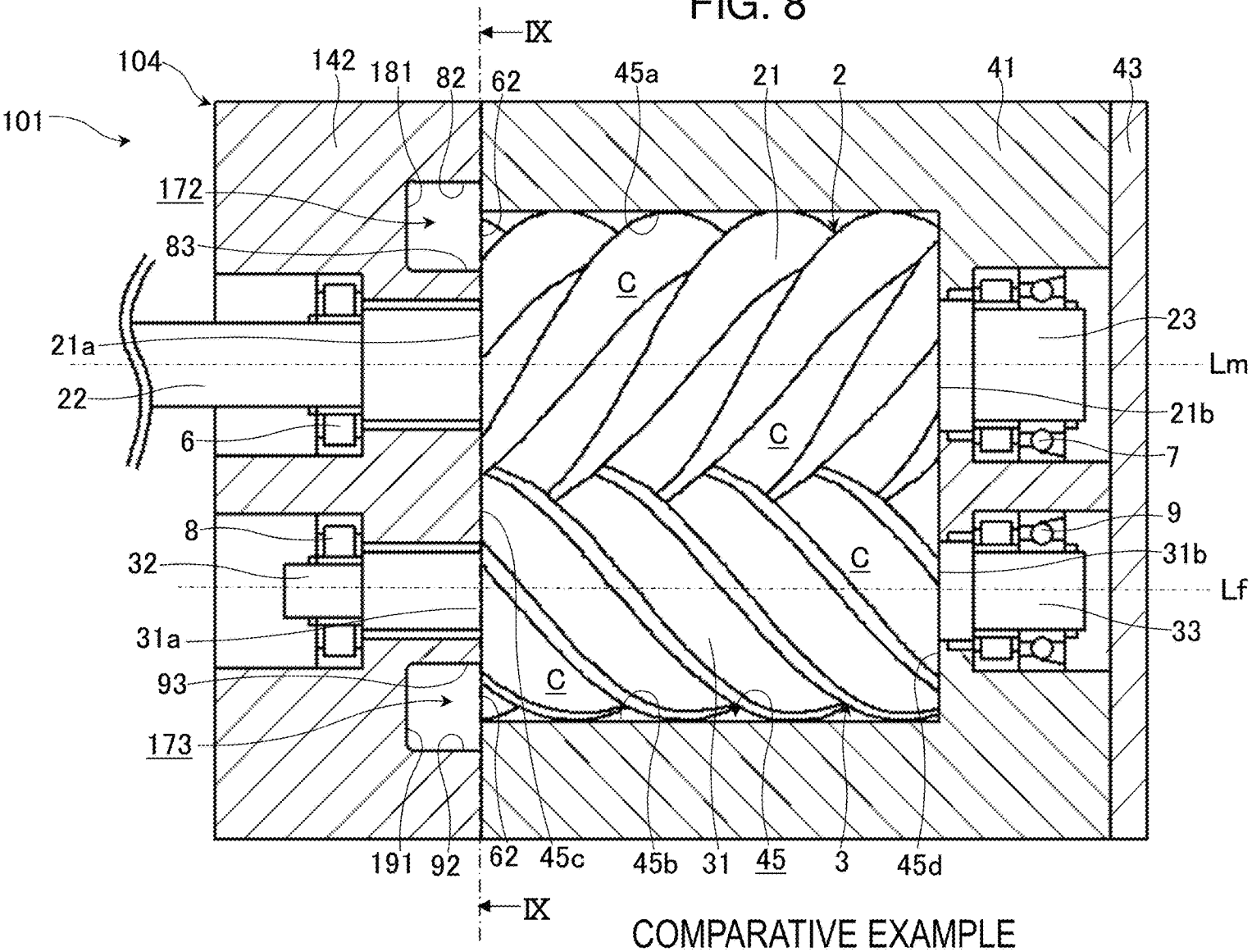
FIG. 8 is a longitudinal cross-sectional view of the screw compressor of the comparative example depicted in FIG. 7 when viewed in the VIII-VIII arrow direction.
Figure 9:
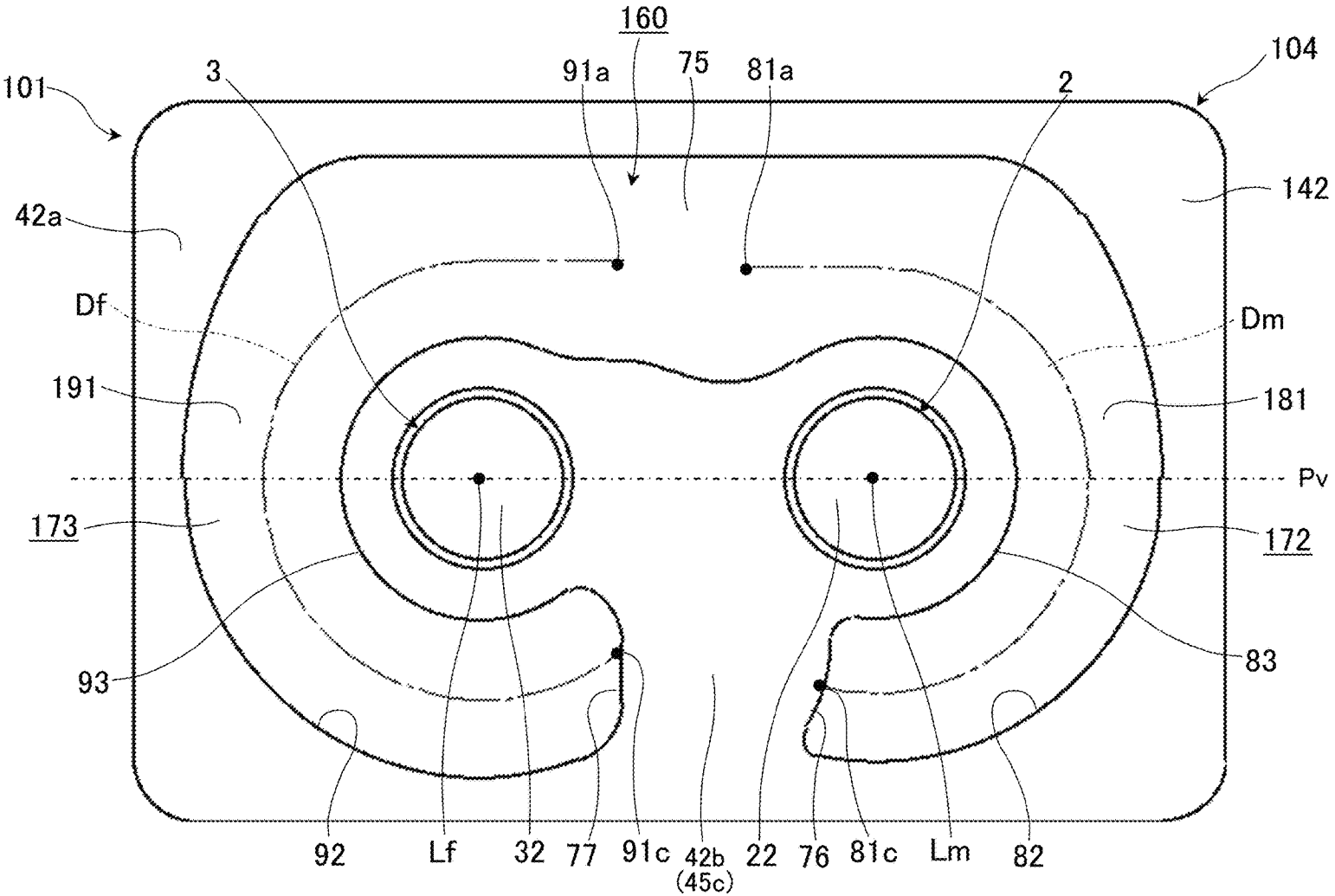
FIG. 9 is a diagram of the screw compressor of the comparative example depicted in FIG. 7 when viewed in the IX-IX arrow direction.
Figure 10:
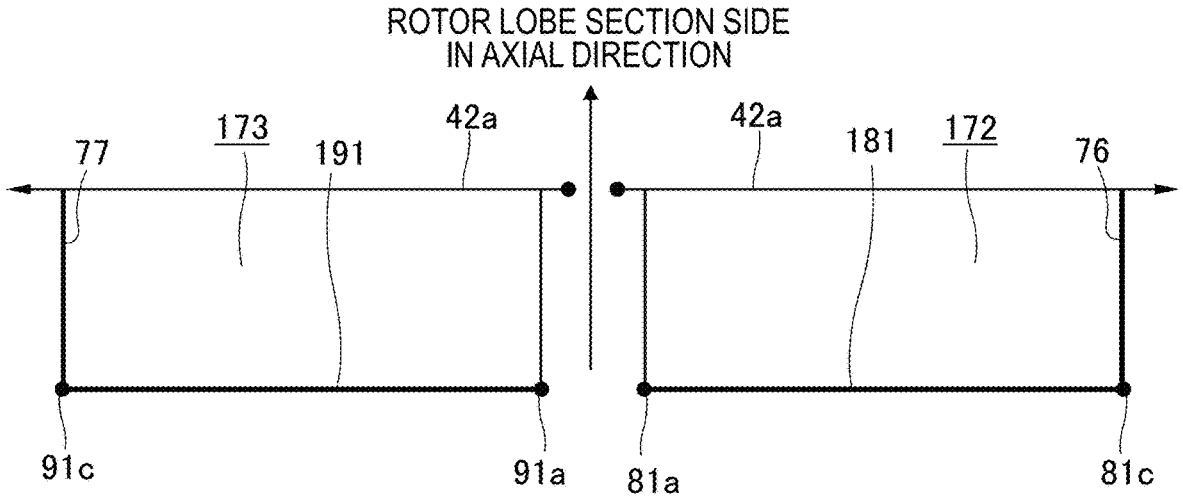
FIG. 10 is an explanatory view depicting the shape of a first flow path wall (the shape of a recessed portion defining a suction flow path) in the suction flow path of the screw compressor of the comparative example depicted in FIG. 9.

Next, the action and effect of the screw compressor according to the first embodiment will be described in comparison with a screw compressor of a comparative example. First, the structure of a suction flow path of the screw compressor in the comparative example will be described by using FIG. 7 to FIG. 10. FIG. 7 is a longitudinal cross-sectional view depicting the screw compressor of the comparative example to the first embodiment of the present invention. FIG. 8 is a longitudinal cross-sectional view of the screw compressor of the comparative example depicted in FIG. 7 when viewed in the VIII-VIII arrow direction. FIG. 9 is a diagram of the screw compressor of the comparative example depicted in FIG. 7 when viewed in the IX-IX arrow direction. FIG. 10 is an explanatory view depicting the shape of a first flow path wall (the shape of a recessed portion forming the suction flow path) in the suction flow path of the screw compressor of the comparative example depicted in FIG. 9. It should be noted that in FIG. 7 to FIG. 10, the same reference numerals as those depicted in FIG. 1 to FIG. 6 denote the similar parts, and thus detailed description thereof is omitted.

The main different point between a screw compressor 101 of the comparative example and the screw compressor 1 according to the present embodiment is that the shapes of a male-side branch flow path 172 and a female-side branch flow path 173 formed in a suction-side casing 142 are different in a suction flow path 160 formed in a casing 104. Other configurations of the screw compressor 101 of the comparative example are similar to those of the screw compressor 1 according to the present embodiment.

Specifically, a first flow path wall 181 of the male-side branch flow path 172 of the comparative example is configured to be maintained equally distant from the suction-side end face 21*a* of the rotor lobe section 21 of the male rotor 2 from the starting end 75 to the male-side termination end 76 as depicted in FIG. 7 to FIG. 9. As similar to the above, a first flow path wall 191 of the female-side branch flow path 173 is configured to be maintained equally distant from the suction-side end face 31*a* of the rotor lobe section 31 of the female rotor 3 from the starting end 75 to the female-side termination end 77.

In details, the first flow path wall 181 of the male-side branch flow path 172 and the first flow path wall 191 of the female-side branch flow path 173 have shapes as depicted in, for example, FIG. 10. FIG. 10 is a diagram obtained by developing the male-side branch flow path 172 and the female-side branch flow path 173 depicted in FIG. 9 along the dashed lines Dm and Df. The first flow path wall 181 of the male-side branch flow path 172 is configured as a flat face equally distant from the suction-side end face 21*a* of the male rotor 2 in the area from the point 81*a* positioned in the vicinity of the starting end 75 of the male-side branch flow path 172 to the point 81*c* positioned at the male-side termination end 76. In other words, the bottom surface of the recessed portion forming the male-side branch flow path 172 in the suction-side casing 142 is configured in such a manner that the depth in the axial direction is substantially constant from the point 81*a* to the point 81*c* positioned at the male-side termination end 76. As similar to the above, the first flow path wall 191 of the female-side branch flow path 173 is configured as a flat face equally distant from the suction-side end face 31*a* of the female rotor 3 in the area from the point 91*a* positioned in the vicinity of the starting end 75 of the female-side branch flow path 173 to the point 91*c* positioned at the female-side termination end 77. In other words, the bottom surface of the recessed portion forming the female-side branch flow path 173 in the suction-side casing 142 is configured in such a manner that that the depth in the axial direction is substantially constant in the area from the point 91*a* to the point 91*c* positioned at the female-side termination end 77.

In the screw compressor 101 of the comparative example, the working fluid flowing in from the introduction flow path 71 of the suction flow path 160 depicted in FIG. 7 is gradually sucked into the working chambers C through the suction port 62 (see FIG. 8) that opens in the axial direction while flowing from the starting end 75 of the male-side branch flow path 172 depicted in FIG. 9 toward the male-side termination end 76, and, and is also gradually sucked into the working chambers C through the suction port 62 that opens in the axial direction while flowing from the starting end 75 of the female-side branch flow path 173 toward the female-side termination end 77. Therefore, the flow rate of the working fluid gradually decreases from the starting end 75 of the male-side branch flow path 172 toward the male-side termination end 76 by the amount sucked into the working chambers C, and gradually decreases from the starting end 75 of the female-side branch flow path 173 toward the female-side termination end 77.

In the screw compressor 101 of the comparative example, the first flow path wall 181 of the male-side branch flow path 172 is maintained substantially equally distant from the suction-side end face 21*a* of the male rotor 2, and the first flow path wall 191 of the female-side branch flow path 173 is maintained substantially equally distant from the suction-side end face 31*a* of the female rotor 3. This causes the working fluid flowing through the male-side branch flow path 172 and the female-side branch flow path 173 to decelerate from the starting end 75 side toward the female-side termination end 77 side. Therefore, the decelerated working fluid increases, by the deceleration, in the amount of acceleration accelerated by the male rotor 2 rotating at a high speed when it is sucked into the working chambers C through the suction port 62, thereby causing an acceleration loss and deteriorating the efficiency of the screw compressor.

In contrast to that, in the screw compressor 1 according to the present embodiment, the first flow path wall 81 of the male-side branch flow path 72 is configured such that at least a partial area in the range from the starting end 75 to the male-side termination end 76 is gradually closer to the rotor lobe section 21 of the male rotor 2 from the starting end 75 side toward the male-side termination end 76 side. As similar to the above, the first flow path wall 91 of the female-side branch flow path 73 is configured such that at least a partial area in the range from the starting end 75 to the female-side termination end 77 is gradually closer to the rotor lobe section 31 of the female rotor 3 from the starting end 75 side toward the female-side termination end 77 side. Accordingly, since there are areas where the flow path cross-sectional areas of the male-side branch flow path 72 and the female-side branch flow path 73 decrease toward the male-side termination end 76 side and the female-side termination end 77 side, the deceleration of the working fluid flowing through the male-side branch flow path 72 and the female-side branch flow path 73 can be accordingly suppressed as compared with the case of the configuration of the screw compressor 101 of the comparative example. Therefore, the acceleration amount when flowing from the male-side branch flow path 72 and the female-side branch flow path 73 into the working chambers C through the suction port 62 can be reduced, and the energy efficiency of the screw compressor 1 can be improved.

As described above, the screw compressor 1 according to the present embodiment includes: the male rotor 2 that has the rotor lobe section 21 (first rotor lobe section) and is rotatable around the axis line Lm (first axis line); the female rotor 3 that has the rotor lobe section 31 (second rotor lobe section) and is rotatable around the axis line Lf (second axis line); and the casing 4 that has the housing chamber 45 for housing the rotor lobe section 21 (first rotor lobe section) and the rotor lobe section 31 (second rotor lobe section) in a state where they mesh with each other and forms the plurality of working chambers C together with the rotor lobe section 21 (first rotor lobe section) and the rotor lobe section 31 (second rotor lobe section). The casing 4 has the suction flow path 60 that introduces the working fluid from the outside of the casing 4 to the working chambers C in the suction process. The suction flow path 60 has: the male-side branch flow path 72 (male-side flow path) that opens in the axial direction of the male rotor 2 with respect to the working chambers C on the male rotor 2 side among the working chambers C in the suction process and that extends from the first starting end 75, which is positioned on one side with respect to the virtual plane Pv passing through the axis line Lm (first axis line) and the axis line Lf (second axis line) and is on the inflow side of the working fluid, to the male-side termination end 76 (first termination end), which is positioned on the other side with respect to the virtual plane Pv; and the female-side branch flow path 73 (female-side flow path) that opens in the axial direction of the female rotor 3 with respect to the working chambers C on the female rotor 3 side among the working chambers C in the suction process and that extends from the second starting end 75, which is positioned on the one side with respect to the virtual plane Pv and is on the inflow side of the working fluid, to the female-side termination end 77 (second termination end), which is positioned on the other side with respect to the virtual plane Pv. The flow path wall defining the male-side branch flow path 72 (male-side flow path) includes the first flow path wall 81 (male-side first flow path wall) that faces the suction-side end face 21*a* side of the rotor lobe section 21 (first rotor lobe section) and extends from the first starting end 75 to the male-side termination end 76 (first termination end), and the flow path wall defining the female-side branch flow path 73 (female-side flow path) includes the first flow path wall 91 (female-side first flow path wall) that faces the suction-side end face 31*a* side of the rotor lobe section 31 (second rotor lobe section) and extends from the second starting end 75 to the female-side termination end 77 (second termination end). The first flow path wall 81 (male-side first flow path wall) is configured such that at least a partial area in a range from the first starting end 75 to the male-side termination end 76 (first termination end) is closer to the rotor lobe section 21 (first rotor lobe section) from the first starting end 75 side toward the male-side termination end 76 (first termination end), or the first flow path wall 91 (female-side first flow path wall) is configured such that at least a partial area in a range from the second starting end 75 to the female-side termination end 77 (second termination end) is closer to the rotor lobe section 31 (second rotor lobe section) from the second starting end 75 side toward the female-side termination end 77 (second termination end).

According to this configuration, the first flow path wall 81 (male-side first flow path wall) in the male-side branch flow path 72 (male-side flow path), which opens in the rotor axial direction with respect to the working chambers C in the suction process, is formed so as to be closer to the rotor lobe section 21 (first rotor lobe section) toward the male-side termination end 76 (first termination end) side, or the first flow path wall 91 (female-side first flow path wall) in the female-side branch flow path 73 (female-side flow path) is formed so as to be closer to the rotor lobe section 31 (second rotor lobe section) toward the female-side termination end 77 (second termination end) side. This causes the flow path cross-sectional area of the male-side branch flow path 72 (male-side flow path) to decrease toward the male-side termination end 76 (first termination end) side, or the flow path cross-sectional area of the female-side branch flow path 73 (female-side flow path) to decrease toward the female-side termination end 77 (second termination end) side. Accordingly, since the deceleration of the working fluid flowing through the male-side branch flow path 72 (male-side flow path) or the female-side branch flow path 73 (female-side flow path) is suppressed, the acceleration loss caused by the deceleration of the working fluid flowing through the suction flow path 60 can be reduced.

In addition, in the present embodiment, the first flow path wall 81 (male-side first flow path wall) has an inclined face that is gradually closer to the rotor lobe section 21 (first rotor lobe section) from the first starting end 75 side toward the male-side termination end 76 (first termination end) side, or the first flow path wall 91 (female-side first flow path wall) has an inclined face that is gradually closer to the rotor lobe section 31 (second rotor lobe section) from the second starting end 75 side toward the female-side termination end 77 (second termination end) side.

According to this configuration, the first flow path wall 81 (male-side first flow path wall) defining the male-side branch flow path 72 (male-side flow path) or the first flow path wall 91 (female-side first flow path wall) defining the female-side branch flow path 73 (female-side flow path) has the inclined face. This allows the flow path cross-sectional areas to be reduced without disturbing the flow of the working fluid in the male-side branch flow path 72 (male-side flow path) or the female-side branch flow path 73 (female-side flow path).

In addition, in the present embodiment, the inclined face in the first flow path wall 81 (male-side first flow path wall) extends from a position on the one side with respect to the virtual plane Pv to the male-side termination end 76 (first termination end), or the inclined face in the first flow path wall 91 (female-side first flow path wall) extends from a position on the one side with respect to the virtual plane Pv to the female-side termination end 77 (second termination end).

According to this configuration, by reducing the flow path cross-sectional area of the male-side branch flow path 72 (male-side flow path) or the female-side branch flow path 73 (female-side flow path) to the male-side termination end 76 (first termination end) or the female-side termination end 77 (second termination end), the deceleration suppressing effect of the working fluid flowing through the male-side branch flow path 72 (male-side flow path) or the female-side branch flow path 73 (female-side flow path) can be enhanced.

In addition, in the present embodiment, the first flow path wall 81 (male-side first flow path wall) is configured such that the inclined face extends from a position on the one side with respect to the virtual plane Pv to the certain first position 81*d* before reaching the male-side termination end 76 (first termination end), and such that an area from the first position 81*d* to the male-side termination end 76 (first termination end) is a flat face equally distant from the rotor lobe section 21 (first rotor lobe section), or the first flow path wall 91 (female-side first flow path wall) is configured such that the inclined face extends from a position on the one side with respect to the virtual plane Pv to the certain second position 91*d* before reaching the female-side termination end 77 (second termination end), and such that an area from the second position 91*d* to the female-side termination end 77 (second termination end) is a flat face equally distant from the rotor lobe section 31 (second rotor lobe section).

According to this configuration, the inclined face of the first flow path wall 81 (male-side first flow path wall) or the first flow path wall 91 (female-side first flow path wall) is limited before the male-side termination end 76 (first termination end) or the female-side termination end 77 (second termination end). This allows machining of the first flow path wall 81 (male-side first flow path wall) or the first flow path wall 91 (female-side first flow path wall) in the area reaching the male-side termination end 76 (first termination end) or the female-side termination end 77 (second termination end) to become easier than in the case of the inclined face.

In addition, in the present embodiment, the male-side branch flow path 72 (male-side flow path) is configured such that the direction from the first starting end 75 to the male-side termination end 76 (first termination end) corresponds to the rotation direction of the male rotor 2, and the female-side branch flow path 73 (female-side flow path) is configured such that the direction from the second starting end 75 to the female-side termination end 77 (second termination end) corresponds to the rotation direction of the female rotor 3.

According to this configuration, the direction of the working fluid flowing through the male-side branch flow path 72 (male-side flow path) and the female-side branch flow path 73 (female-side flow path) corresponds to the rotation direction of the male rotor 2 and the female rotor 3. Therefore, the pressure loss of the working fluid when flowing into the working chambers C from the male-side branch flow path 72 and the female-side branch flow path 73 can be reduced.

In addition, in the present embodiment, the casing 4 has: the main casing 41 (first casing) configured to house the rotor lobe section 21 (first rotor lobe section) and the rotor lobe section 31 (second rotor lobe section); and the suction-side casing 42 (second casing) that has the male-side branch flow path 72 (male-side flow path) and the female-side branch flow path 73 (female-side flow path), is attached to the main casing 41 (first casing), and is a member different from the main casing 41 (first casing).

Second Embodiment

Figure 11:
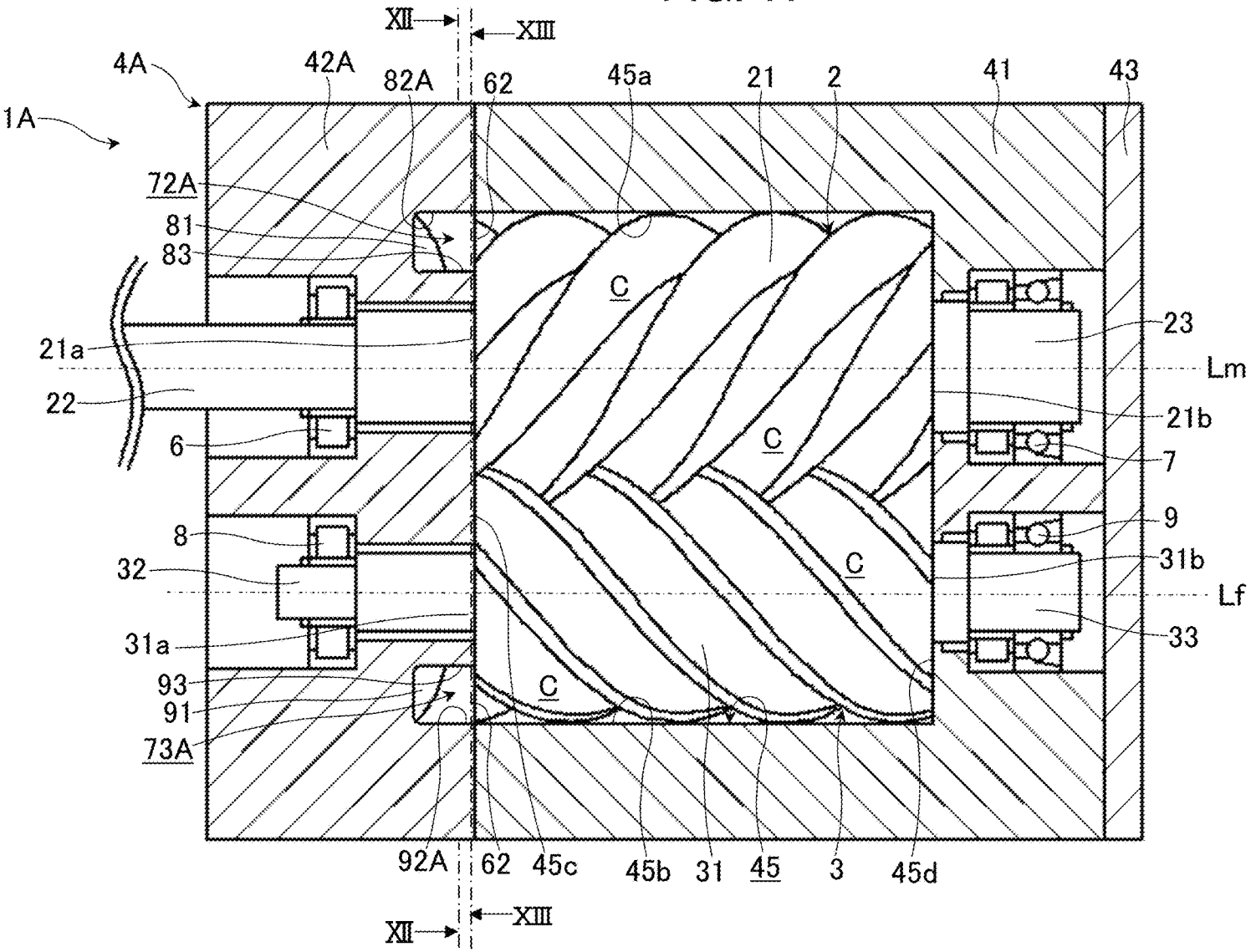
FIG. 11 is a longitudinal cross-sectional view depicting a screw compressor according to a second embodiment of the present invention.
Figure 12:
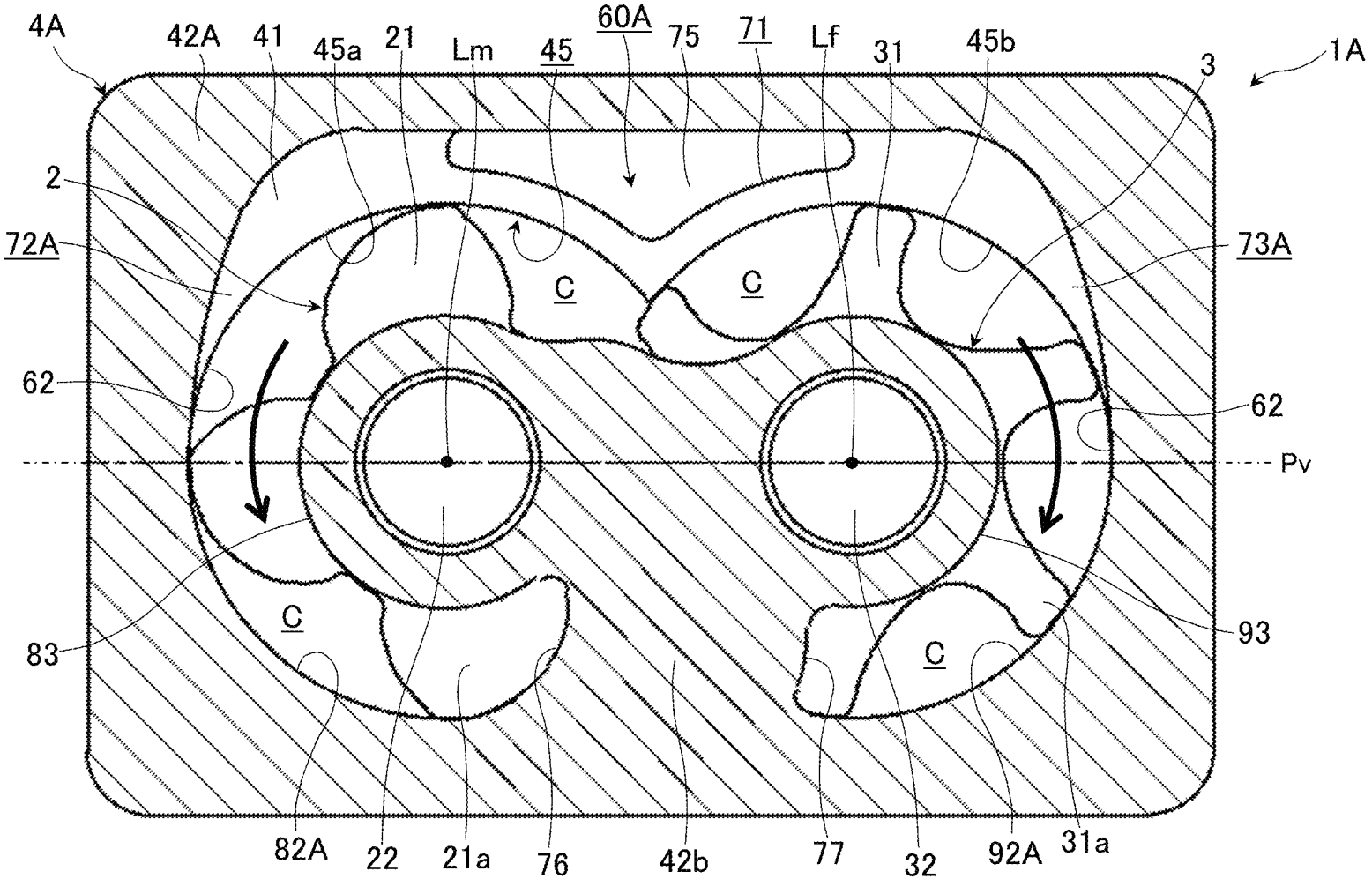
FIG. 12 is a transverse cross-sectional view of the screw compressor according to the second embodiment depicted in FIG. 11 when viewed in the XII-XII arrow direction.
Figure 13:
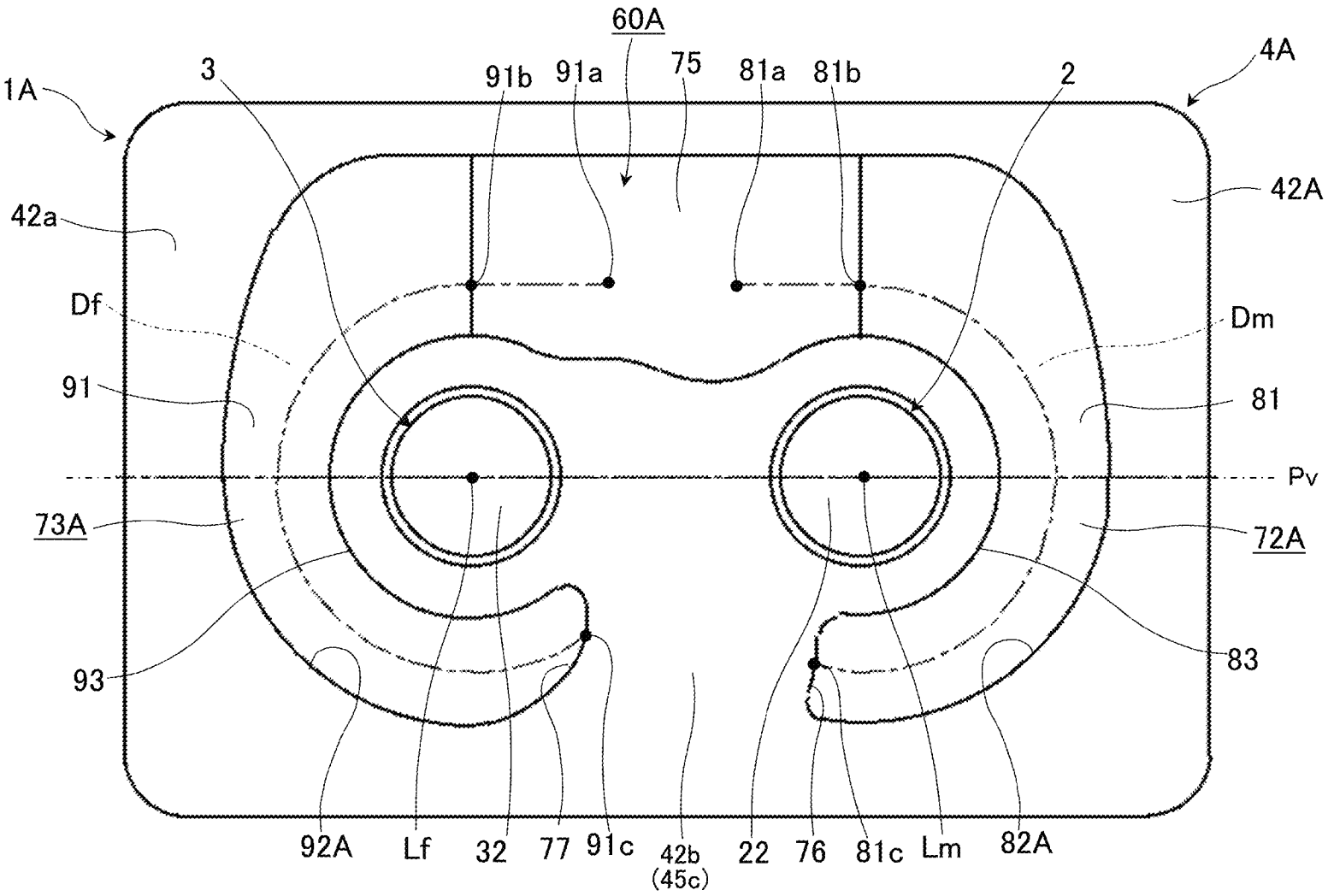
FIG. 13 is a diagram of the screw compressor according to the second embodiment depicted in FIG. 11 when viewed in the XIII-XIII arrow direction.

Next, a screw compressor according to a second embodiment of the present invention will be described by using FIG. 11 to FIG. 13. FIG. 11 is a longitudinal cross-sectional view depicting the screw compressor according to the second embodiment of the present invention. FIG. 12 is a transverse cross-sectional view of the screw compressor according to the second embodiment depicted in FIG. 11 when viewed in the XII-XII arrow direction. FIG. 13 is a diagram of the screw compressor according to the second embodiment depicted in FIG. 11 when viewed in the XIII-XIII arrow direction. It should be noted that in FIG. 11 to FIG. 13, the same reference numerals as those depicted in FIG. 1 to FIG. 10 denote the similar parts, and thus detailed description thereof is omitted.

The main different point between a screw compressor 1A according to the second embodiment and the screw compressor 1 according to the first embodiment is that the shapes of a male-side branch flow path 72A and a female-side branch flow path 73A formed in a suction-side casing 42A are different in a suction flow path 60A formed in a casing 4A. Other configurations of the screw compressor 1A of the present embodiment are similar to those of the screw compressor 1 according to the first embodiment.

Specifically, among the flow path walls defining the male-side branch flow path 72A, a second flow path wall 82A positioned outward in the radial direction of the male rotor 2 is configured to be partially and substantially flush with the male-side inner peripheral wall face 45*a* that is a wall face of the housing chamber (bore) 45 of the casing 4A when viewed from the axial direction of the male rotor 2 as depicted in FIG. 11 and FIG. 12. In details, the second flow path wall 82A is configured to be flush with the male-side inner peripheral wall face 45*a* of the housing chamber (bore) 45 in a range from the position of the virtual plane Pv to the male-side termination end 76. The position of the second flow path wall 82A in the radial direction of the male rotor 2 is the smallest position in the range where the opening that opens in the axial direction of the housing chamber (bore) 45 is not closed. The second flow path wall 82A of the present embodiment is configured to be closer to the third flow path wall 83 side than the second flow path wall 82 of the first embodiment. That is, as depicted in FIG. 13, the interval in the rotor radial direction between the second flow path wall 82A and the third flow path wall 83 in the male-side branch flow path 72A (flow path width of the male-side branch flow path 72A) is narrower than the flow path width of the male-side branch flow path 72 of the first embodiment. Therefore, the flow path cross-sectional area of the male-side branch flow path 72A is smaller than the flow path cross-sectional area of the male-side branch flow path 72 of the first embodiment. This allows a decrease in the flow speed of the working fluid flowing through the male-side branch flow path 72A to be further suppressed as compared with the first embodiment, so that the acceleration loss can be further reduced.

As similar to the above, among the flow path walls defining the female-side branch flow path 73A, a second flow path wall 92A positioned outward in the radial direction of the female rotor 3 is configured to be partially and substantially flush with the female-side inner peripheral wall face 45*b* that is a wall face of the housing chamber (bore) 45 of the casing 4A when viewed from the axial direction of the female rotor 3 as depicted in FIG. 11 and FIG. 12. In details, the second flow path wall 92A is configured to be flush with the female-side inner peripheral wall face 45*b* of the housing chamber (bore) 45 in a range from the position of the virtual plane Pv to the female-side termination end 77. That is, as depicted in FIG. 13, the interval in the rotor radial direction between the second flow path wall 92A and the third flow path wall 93 in the female-side branch flow path 73A (flow path width of the female-side branch flow path 73A) is narrower than the flow path width of the female-side branch flow path 73 of the first embodiment. Therefore, the flow path cross-sectional area of the female-side branch flow path 73A is smaller than the flow path cross-sectional area of the female-side branch flow path 73 of the first embodiment. This allows a decrease in the flow speed of the working fluid flowing through the female-side branch flow path 73A to be further suppressed as compared with the first embodiment, so that the acceleration loss can be further reduced.

As similar to the first embodiment, according to the second embodiment described above, the first flow path wall 81 (male-side first flow path wall) in the male-side branch flow path 72A (male-side flow path) that opens in the rotor axial direction with respect to—the working chambers C in the suction process is formed so as to be closer to the rotor lobe section 21 (first rotor lobe section) toward the male-side termination end 76 (first termination end) side, or the first flow path wall 91 (female-side first flow path wall) in the female-side branch flow path 73A (female-side flow path) is formed so as to be closer to the rotor lobe section 31 (second rotor lobe section) toward the female-side termination end 77 (second termination end) side. This causes the flow path cross-sectional area of the male-side branch flow path 72A (male-side flow path) decreases toward the male-side termination end 76 (first termination end) side, or the flow path cross-sectional area of the female-side branch flow path 73A (female-side flow path) decreases toward the female-side termination end 77 (second termination end) side. Accordingly, the deceleration of the working fluid flowing through the male-side branch flow path 72A (male-side flow path) or the female-side branch flow path 73A (female-side flow path) is suppressed, and the acceleration loss caused by the deceleration of the working fluid flowing through the suction flow path 60A can be reduced.

In addition, in the present embodiment, when viewed from the axial direction of the male rotor 2, the second flow path wall 82A that defines the male-side branch flow path 72A (male-side flow path) and is positioned outward in the radial direction of the male rotor 2 is configured to be at least partially flush with the male-side inner peripheral wall face 45*a* that is a wall face of the housing chamber (bore) 45, or when viewed from the axial direction of the female rotor 3, the second flow path wall 92A that defines the female-side branch flow path 73A (male-side flow path) and is positioned outward in the radial direction of the female rotor 3 is configured to be at least partially flush with the female-side inner peripheral wall face 45*b* that is a wall face of the housing chamber (bore) 45.

According to this configuration, in flow components of the working fluid flowing from the male-side branch flow path 72A (male-side flow path) or the female-side branch flow path 73A (female-side flow path) toward the working chambers C, a component in the rotor radial direction less likely to be generated, and thus the pressure loss can be reduced.

In addition, in the present embodiment, when viewed from the axial direction of the male rotor 2, the second flow path wall 82A of the male-side branch flow path 72A (male-side flow path) is configured to be flush with the male-side inner peripheral wall face 45*a* that is a wall face of the housing chamber (bore) 45 in a range from the position of the virtual plane Pv to the male-side termination end 76 (first termination end), or when viewed from the axial direction of the female rotor 3, the second flow path wall 92A of the female-side branch flow path 73A (female-side flow path) is configured to be flush with the female-side inner peripheral wall face 45*b* that is a wall face of the housing chamber (bore) 45 in a range from the position of the virtual plane Pv to the female-side termination end 77 (second termination end).

According to this configuration, the flow path cross-sectional area of the male-side branch flow path 72A (male-side flow path) or the female-side branch flow path 73A (female-side flow path) becomes smaller than that in the case of the configuration of the first embodiment. This allows the amount accelerated by the male rotor 2 or female rotor 3 rotating at a high speed when sucked from the male-side branch flow path 72A (male-side flow path) or the female-side branch flow path 73A (female-side flow path) into the working chambers C to be further suppressed, so that the deterioration of the efficiency of the screw compressor due to the acceleration loss can be suppressed.

Third Embodiment

Figure 14:
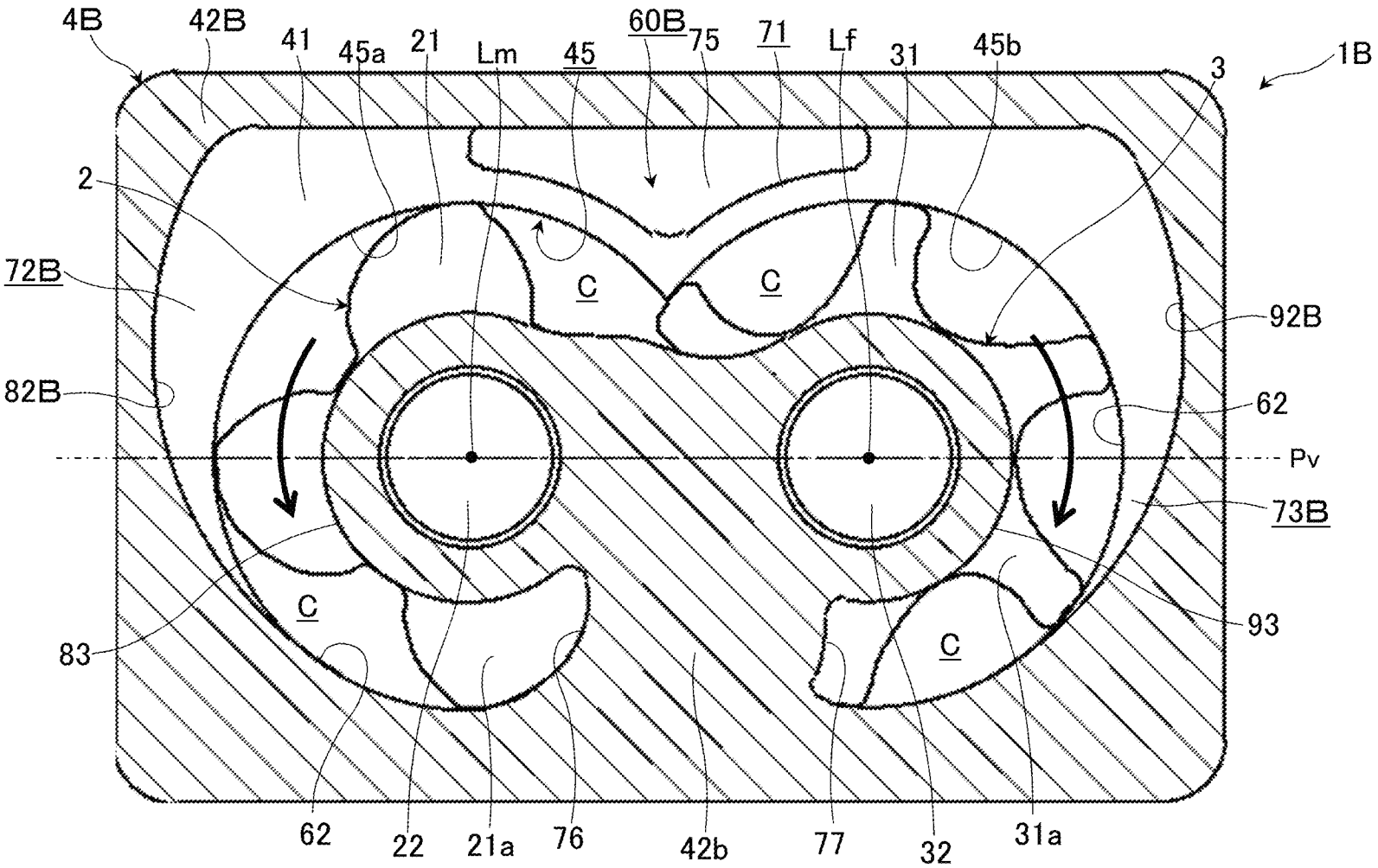
FIG. 14 is a transverse cross-sectional view of a screw compressor according to a third embodiment of the present invention when viewed in the arrow direction similar to the III-III arrow direction depicted in FIG. 2.

Next, a screw compressor according to a third embodiment of the present invention will be described by using FIG. 14. FIG. 14 is a transverse cross-sectional view of the screw compressor according to the third embodiment of the present invention when viewed in the arrow direction similar to the III-III arrow direction depicted in FIG. 2. It should be noted that in FIG. 14, the same reference numerals as those depicted in FIG. 1 to FIG. 13 denote the similar parts, and thus detailed description thereof is omitted.

The main different point between a screw compressor 1B according to the second embodiment and the screw compressor 1 according to the first embodiment is that the shapes of a male-side branch flow path 72B and a female-side branch flow path 73B formed in a suction-side casing 42B are different in a suction flow path 60B formed in a casing 4B. Other configurations of the screw compressor 1B of the present embodiment are similar to those of the screw compressor 1 according to the first embodiment.

Specifically, among the flow path walls defining the male-side branch flow path 72B, a second flow path wall 82B positioned on a radially outer side of the male rotor 2 is configured to be partially and substantially flush with the male-side inner peripheral wall face 45*a* that is a wall face of the housing chamber (bore) 45 of the casing 4B when viewed from the axial direction of the male rotor 2 as depicted in FIG. 14. In details, the second flow path wall 82B is configured to be gradually closer from the radially outer side of the male rotor 2 to and then be flush with the male-side inner peripheral wall face 45*a* of the housing chamber (bore) 45 from the position of the virtual plane Pv toward the male-side termination end 76. The second flow path wall 82B of the present embodiment is configured to be closer to the third flow path wall 83 toward the male-side termination end 76 side. That is, as depicted in FIG. 14, since the interval in the rotor radial direction between the second flow path wall 82B and the third flow path wall 83 in the male-side branch flow path 72B (flow path width of the male-side branch flow path 72B) is narrower toward the male-side termination end 76 side, the flow path cross-sectional area of the male-side branch flow path 72B becomes smaller toward the male-side termination end 76 side.

As similar to the above, among the flow path walls defining the female-side branch flow path 73B, a second flow path wall 92B positioned on a radially outer side of the female rotor 3 is configured to be partially and substantially flush with the female-side inner peripheral wall face 45*b* that is a wall face of the housing chamber (bore) 45 of the casing 4B when viewed from the axial direction of the female rotor 3. In details, the second flow path wall 92B is configured to be gradually closer from the radially outer side of the female rotor 3 to and then be flush with the female-side inner peripheral wall face 45*b* of the housing chamber (bore) 45 from the position of the virtual plane Pv toward the female-side termination end 77. The second flow path wall 92B of the present embodiment is configured to be closer to the third flow path wall 93 toward the female-side termination end 77 side. That is, as depicted in FIG. 14, since the interval in the rotor radial direction between the second flow path wall 92B and the third flow path wall 93 in the female-side branch flow path 73B (flow path width of the female-side branch flow path 73B) is narrower toward the female-side termination end 77 side, the flow path cross-sectional area of the female-side branch flow path 73B becomes smaller toward the female-side termination end 77 side.

The structures of the male-side branch flow path 72B and the female-side branch flow path 73B of the present embodiment are preferable in the case where it is difficult, due to the miniaturization of the screw compressor, to lengthen an area where the second flow path wall 82B and the second flow path wall 92B are flush with the male-side inner peripheral wall face 45*a* and the female-side inner peripheral wall face 45*b*, which are the wall faces of the housing chamber (bore) 45 of the casing 4B.

As similar to the first embodiment, according to the third embodiment described above, the first flow path wall 81 (male-side first flow path wall) in the male-side branch flow path 72B (male-side flow path) that opens in the rotor axial direction with respect to the working chambers C in the suction process is formed so as to be closer to the rotor lobe section 21 (first rotor lobe section) toward the male-side termination end 76 (first termination end) side, or the first flow path wall 91 (female-side first flow path wall) in the female-side branch flow path 73B (female-side flow path) is formed so as to be closer to the rotor lobe section 31 (second rotor lobe section) toward the female-side termination end 77 (second termination end) side. This causes the flow path cross-sectional area of the male-side branch flow path 72B (male-side flow path) decreases toward the male-side termination end 76 (first termination end) side, or the flow path cross-sectional area of the female-side branch flow path 73B (female-side flow path) decreases toward the female-side termination end 77 (second termination end) side. Accordingly, the deceleration of the working fluid flowing through the male-side branch flow path 72B (male-side flow path) or the female-side branch flow path 73B (female-side flow path) is suppressed, and the acceleration loss caused by the deceleration of the working fluid flowing through the suction flow path 60B can be reduced.

In addition, in the present embodiment, when viewed from the axial direction of the male rotor 2, the second flow path wall 82B of the male-side branch flow path 72B (male-side flow path) is configured to be gradually closer from an outer side in the radial direction of the male rotor 2 to and then be flush with the male-side inner peripheral wall face 45*a*, a wall face of the housing chamber (bore) 45, from the position of the virtual plane Pv toward the male-side termination end 76 (first termination end) side, or when viewed from the axial direction of the female rotor 3, the second flow path wall 92B of the female-side branch flow path 73B (female-side flow path) is configured to be gradually closer from an outer side in the radial direction of the female rotor 3 to and then be flush with the female-side inner peripheral wall face 45*b*, a wall face of the housing chamber (bore) 45, from the position of the virtual plane Pv toward the female-side termination end 77 (second termination end) side.

According to this configuration, the flow path cross-sectional area of the male-side branch flow path 72B (male-side flow path) or the female-side branch flow path 73B (female-side flow path) is gradually reduced toward the male-side termination end 76 (first termination end) side or the female-side termination end 77 (second termination end) side. This allows the deceleration of the working fluid flowing through the male-side branch flow path 72B (male-side flow path) or the female-side branch flow path 73B (female-side flow path) to be further suppressed.

Other Embodiments

It should be noted that the present invention is not limited to the above-described embodiments, but includes various modified examples. The above embodiments have been described in detail for the purpose of clearly explaining the present invention, and are not necessarily limited to those having all the described configurations. For example, a part of a configuration of one embodiment can be replaced by a configuration of another embodiment, or a configuration of one embodiment can be added to a configuration of another embodiment. In addition, a part of a configuration of each embodiment can be added to, deleted from, or replaced with another configuration.

For example, in the above-described embodiments, the example in which the suction port 62 of the suction flow path 60 is configured to open only in the rotor axial direction with respect to the working chambers C in the suction process has been denoted. However, the suction port can also be configured to open in the rotor radial direction with respect to the working chambers C in the suction process. However, in the case of this configuration, a leakage of the working fluid flowing into the working chambers occurs by centrifugal action through the suction port that opens in the rotor radial direction. Therefore, the configuration in which the suction port 62 opens only in the rotor axial direction is more preferable for suppressing the deceleration of the working fluid.

DESCRIPTION OF REFERENCE CHARACTERS

1, 1A, 1B: Screw compressor
2: Male rotor
3: Female rotor
4, 4A, 4B: Casing
21: Rotor lobe section (first rotor lobe section)
31: Rotor lobe section (second rotor lobe section)
41: Main casing (first casing)
42, 42A, 42B: Suction-side casing (second casing)
45: Bore (housing chamber)
45*a*: Male-side inner peripheral wall face (wall face of housing chamber)
45*b*: Female-side inner peripheral wall face (wall face of housing chamber)
60, 60A, 60B: Suction flow path
72, 72A, 72B: Male-side branch flow path (male-side flow path)
73, 73A, 73B: Female-side branch flow path (female-side flow path)
75: Starting end (first starting end, second starting end)
76: Male-side termination end (first termination end)
77: Female-side termination end (second termination end)
81: First flow path wall (male-side first flow path wall)
82, 82A, 82B: Second flow path wall
81*d*: Certain point (certain first position)
91: First flow path wall (female-side first flow path wall)
91*d*: Certain point (certain second position)
92, 92A, 92B: Second flow path wall
C: Working chamber
Lm: Axis line (first axis line)
Lf: Axis line (second axis line)
Pv: Virtual plane

The invention claimed is:

1. A screw compressor comprising:

a male rotor that has a first rotor lobe section and is rotatable around a first axis line;

a female rotor that has a second rotor lobe section and is rotatable around a second axis line;

a casing that has a housing chamber for housing the first rotor lobe section and the second rotor lobe section in a state of being meshed with each other and forming a plurality of working chambers; and a suction flow path disposed in the casing configured to introduce working fluid from an outside of the casing to working chambers in a suction process, the suction flow path including:

a male-side flow path that opens in an axial direction of the male rotor with respect to working chambers on the male rotor side among the working chambers in the suction process and that extends from a first starting end to a first termination end, the first starting end being positioned on one side with respect to a virtual plane passing through the first axis line and the second axis line and being on an inflow side of the working fluid, the first termination end being positioned on other side with respect to the virtual plane, and a female-side flow path that opens in an axial direction of the female rotor with respect to working chambers on the female rotor side among the working chambers in the suction process and that extends from a second starting end to a second termination end, the second starting end being positioned on the one side with respect to the virtual plane and being on the inflow side of the working fluid, the second termination end being positioned on the other side with respect to the virtual plane, wherein the male-side flow path includes a male-side first flow path wall that faces a suction-side end face side of the first rotor lobe section and extends from the first starting end to the first termination end, wherein the female-side flow path includes a female-side first flow path wall that faces a suction-side end face side of the second rotor lobe section and extends from the second starting end to the second termination end, wherein the male-side first flow path wall is configured such that at least a partial area in a range from the first starting end to the first termination end is closer to the first rotor lobe section from the first starting end side toward the first termination end side, or the female-side first flow path wall is configured such that at least a partial area in a range from the second starting end to the second termination end is closer to the second rotor lobe section from the second starting end side toward the second termination end side, wherein the male-side first flow path wall has an inclined face that is gradually closer to the first rotor lobe section from the first starting end side toward the first termination end side, or the female-side first flow path wall has an inclined face that is gradually closer to the second rotor lobe section from the second starting end side toward the second termination end side, and wherein the male-side first flow path wall is configured such that the inclined face extends from a position on the one side with respect to the virtual plane to a certain first position before reaching the first termination end, and such that an area from the first position to the first termination end is a flat face equally distant from the first rotor lobe section, or the female-side first flow path wall is configured such that the inclined face extends from a position on the one side with respect to the virtual plane to a certain second position before reaching the second termination end, and such that an area from the second position to the second termination end is equally distant from the second rotor lobe section.

2. The screw compressor according to claim 1, wherein the inclined face of the male-side first flow path wall extends from a position on the one side with respect to the virtual plane to the first termination end, or the inclined face of the female-side first flow path wall extends from a position on the one side with respect to the virtual plane to the second termination end.

3. The screw compressor according to claim 1, wherein a second flow path wall that defines the male-side flow path and is positioned outward in a radial direction of the male rotor is configured to, at least partially, be flush with a wall face of the housing chamber when viewed from the axial direction of the male rotor, or a second flow path wall that defines the female-side flow path and is positioned outward in a radial direction of the female rotor is configured to, at least partially, be flush with the wall face of the housing chamber when viewed from the axial direction of the female rotor.

4. The screw compressor according to claim 3, wherein the second flow path wall of the male-side flow path is configured to be gradually closer from an outer side in the radial direction of the male rotor to and then be flush with the wall face of the housing chamber from a position of the virtual plane toward the first termination end, when viewed from the axial direction of the male rotor, or the second flow path wall of the female-side flow path is configured to be gradually closer from an outer side in the radial direction of the female rotor to and then be flush with the wall face of the housing chamber from the position of the virtual plane toward the second termination end, when viewed from the axial direction of the female rotor.

5. The screw compressor according to claim 3, wherein the second flow path wall of the male-side flow path is configured to be flush with the wall face of the housing chamber in a range from a position of the virtual plane to the first termination end when viewed from the axial direction of the male rotor, or the second flow path wall of the female-side flow path is configured to be flush with the wall face of the housing chamber in a range from the position of the virtual plane to the second termination end when viewed from the axial direction of the female rotor.

6. The screw compressor according to claim 1, wherein the male-side flow path is configured such that a direction from the first starting end to the first termination end corresponds to a rotation direction of the male rotor, and the female-side flow path is configured such that a direction from the second starting end to the second termination end corresponds to a rotation direction of the female rotor.

7. The screw compressor according to claim 1, wherein the casing includes:

a first casing configured to house the first rotor lobe section and the second rotor lobe section, and a second casing having the male-side flow path and the female-side flow path, the second casing being a member different from the first casing and being attached to the first casing.

8. The screw compressor according to claim 1, wherein the suction flow path is configured to open only in the axial directions of the male rotor and the female rotor with respect to the working chambers in the suction process.

* * * * *